US012326006B2

(12) United States Patent
Dragseth et al.

(10) Patent No.: US 12,326,006 B2
(45) Date of Patent: Jun. 10, 2025

(54) PREFABRICATED/MODULAR SAUNA

(71) Applicant: The Superior Sauna Company, LLC, Ashland, WI (US)

(72) Inventors: David Dragseth, Ashland, WI (US); Seth Kiefer, Ashland, WI (US); Justus Benson, Soldiers Grove, WI (US); Shaelyn Crutchley, Minneapolis, MN (US)

(73) Assignee: The Superior Sauna Company, LLC, Ashland, WI (US)

( * ) Notice: Subject to any disclaimer, the term of this patent is extended or adjusted under 35 U.S.C. 154(b) by 0 days.

(21) Appl. No.: 18/487,016

(22) Filed: Oct. 13, 2023

(65) Prior Publication Data

US 2024/0125133 A1 Apr. 18, 2024

Related U.S. Application Data

(60) Provisional application No. 63/379,474, filed on Oct. 14, 2022.

(51) Int. Cl.
*E04H 1/12* (2006.01)

(52) U.S. Cl.
CPC ..... *E04H 1/12* (2013.01); *E04H 2001/1288* (2013.01)

(58) Field of Classification Search
CPC ..... E04H 1/12; E04H 1/1244; E04H 1/1266; E04H 2001/1288
USPC ..... 4/524, 526; 52/79.1, 656.1
See application file for complete search history.

(56) References Cited

U.S. PATENT DOCUMENTS 3,137,967 A * 6/1964 Flieth ..... A63H 33/08 52/93.2
3,299,594 A * 1/1967 Kellert ..... E04B 1/34315 52/777
3,422,465 A * 1/1969 Jones ..... A61H 33/06 392/360

(Continued)

FOREIGN PATENT DOCUMENTS

AU 2011201797 A1 11/2011
KR 200474957 Y1 * 11/2014 ..... A61H 33/065

OTHER PUBLICATIONS

KR-200474957-Y1 Translation (Year: 2024).*

*Primary Examiner* — Erin Deery
*Assistant Examiner* — William R Klotz
(74) *Attorney, Agent, or Firm* — Scale LLP

(57) ABSTRACT

Disclosed are a prefabricated/modular sauna and methods of manufacturing and assembling a prefabricated/modular sauna. For instance, a prefabricated/modular sauna may include: a base frame; a plurality of posts; a plurality of panels; a roof frame; and a roof panel. The base frame and the roof frame include beams and have beam intersections between adjacent beams, each beam intersection is formed of a lap joint and a connector. The panels are secured in post dados of the posts and beam dados of the beams. The posts are secured in notches of base frame beams and roof frame beams. In some cases, the panels include a pre-packaged sauna assembly panel. In some cases, panels and posts are secured against loading forces, lateral forces, or compression forces by (1) interconnected beams and posts in compression or tension, and (2) mechanical connectors (e.g., pins, bolts, screws).

20 Claims, 30 Drawing Sheets

(56) References Cited

U.S. PATENT DOCUMENTS 3,457,923 A * 7/1969 Johnston, Jr. ..... A61D 7/00 607/83
3,571,965 A * 3/1971 Gibb ..... A63H 33/105 446/105
4,485,598 A * 12/1984 Guardiani ..... E04C 3/34 52/745.03
4,677,806 A * 7/1987 Tuomi ..... E04C 3/14 52/642
5,036,634 A * 8/1991 Lessard ..... E04H 1/1205 D25/16
5,469,678 A * 11/1995 Zamerovsky ..... E04C 3/42 403/231
5,527,103 A * 6/1996 Pittman ..... A47B 47/042 312/265.5
6,389,765 B1 * 5/2002 Hautala ..... E04B 2/702 52/656.1
8,789,325 B2 * 7/2014 Verhaeghe ..... E04B 2/705 52/561
11,821,195 B1 * 11/2023 Farber ..... E04B 1/34321
2002/0046422 A1 * 4/2002 Perett ..... E04H 1/125 4/524
2007/0050903 A1 * 3/2007 Sappenfield ..... A61H 33/06 4/524
2007/0245638 A1 * 10/2007 Lai ..... E04H 1/125 52/79.1
2008/0016792 A1 * 1/2008 Messman ..... E04B 1/3205 52/93.1
2009/0019635 A1 * 1/2009 Chen ..... A61H 33/066 4/531
2009/0205277 A1 * 8/2009 Gibson ..... E04D 13/1625 52/656.1
2014/0041111 A1 * 2/2014 Qiao ..... A61H 33/066 4/524
2015/0040308 A1 * 2/2015 Lee ..... A61H 33/066 4/524
2021/0054614 A1 * 2/2021 Benard ..... E04B 7/22
2021/0137781 A1 * 5/2021 Zack ..... A61H 33/063
2021/0177694 A1 * 6/2021 Arnold ..... A61H 33/065
2021/0205168 A1 * 7/2021 Sauer ..... A47C 13/00

* cited by examiner

PREFABRICATED/MODULAR SAUNA

CROSS-REFERENCE TO RELATED APPLICATION(S)

This application claims the benefit of priority under 35 U.S.C. §§ 120 and 119(e) of U.S. provisional application No. 63/379,474, filed Oct. 14, 2022, entitled "Prefabricated Sauna," the entire contents of which is incorporated herein by reference.

TECHNICAL FIELD

Various aspects of the present disclosure relate generally to prefabricated saunas or modular saunas and to methods of manufacturing and assembling prefabricated saunas or modular saunas.

BACKGROUND

Generally, saunas are labor intensive and difficult to manufacture and/or assembly. In some cases, saunas require a trained electrician to install sauna controls, a heater, and other electrical features (such as lights). In some cases, saunas require complex mechanical systems to provide structural strength. In some cases, saunas may be difficult to assemble due to complicated arrangement. In some cases, saunas may be difficult to transport in a de-assembled state. In some cases, saunas may change shape over time (e.g., due to humidity and heat cycling), and maintenance and/or modification may be required.

The present disclosure is directed to overcoming one or more of these above-referenced challenges.

SUMMARY OF THE DISCLOSURE

According to certain aspects of the disclosure, disclosed are a prefabricated/modular saunas and methods of manufacturing and assembling a prefabricated/modular saunas.

In some cases, a prefabricated sauna may include: a base frame forming a base footprint; a floor panel configured to be disposed on the base frame; a plurality of posts; a plurality of panels, wherein a first panel of the plurality of panels includes a door, a second panel of the plurality of panels includes a sauna assembly, the sauna assembly includes: a heating system disposed on an interior wall of the second panel facing an interior volume of the prefabricated sauna, an electrical system disposed on an internal volume of the second panel and connected to the heating system, and an electrical outlet disposed on an exterior wall of the second panel facing an exterior of the prefabricated sauna and connected to the electrical system; a roof frame forming a roof footprint; and a roof panel configured to be disposed on the roof frame, wherein each of the base frame and the roof frame includes a plurality of beams that form respective perimeters of the respective footprints and have beam intersections between adjacent beams, each beam intersection is formed of a lap joint and a pin, the plurality of panels are respectively secured in post dados of the posts and beam dados of the beams; each of the plurality of posts are secured in respective base beam notches using a base post pin that is inserted into a hole of the base frame and a hole on a bottom face of the plurality of posts; and each of the plurality of posts are secured in respective roof beam notches using a roof post pin that is inserted into a hole of the roof beam notch and a hole on a top face of the plurality of posts.

In some cases, a modular sauna may include: a plurality of modular units, wherein each modular unit includes: a base frame forming a base footprint; a floor panel configured to be disposed on the base frame; a plurality of posts; a plurality of panels, a roof frame forming a roof footprint; and a roof panel configured to be disposed on the roof frame; and at least one heating infrastructure to heat an interior volume of the modular sauna, wherein each of the base frame and the roof frame includes a plurality of beams that form respective perimeters of the respective footprints and have beam intersections between adjacent beams, each beam intersection is formed of a lap joint and a pin, the plurality of panels are respectively secured in post dados of the posts and beam dados of the beams; each of the plurality of posts are secured in respective base beam notches using a base post pin that is inserted into a hole of the base frame and a hole on a bottom face of the plurality of posts; and each of the plurality of posts are secured in respective roof beam notches using a roof post pin that is inserted into a hole of the roof beam notch and a hole on a top face of the plurality of posts.

Additional objects and advantages of the disclosed technology will be set forth in part in the description that follows, and in part will be apparent from the description, or may be learned by practice of the disclosed technology.

It is to be understood that both the foregoing general description and the following detailed description are exemplary and explanatory only and are not restrictive of the disclosed technology, as claimed.

BRIEF DESCRIPTION OF THE DRAWINGS

The accompanying drawings, which are incorporated in and constitute a part of this specification, illustrate various exemplary aspects and together with the description, serve to explain the principles of the disclosed technology.

DETAILED DESCRIPTION

In general, the present disclosure is directed to a prefabricated/modular sauna and methods of manufacturing and assembling a prefabricated/modular sauna.

Prefabricated/Modular Sauna

Figure 1:
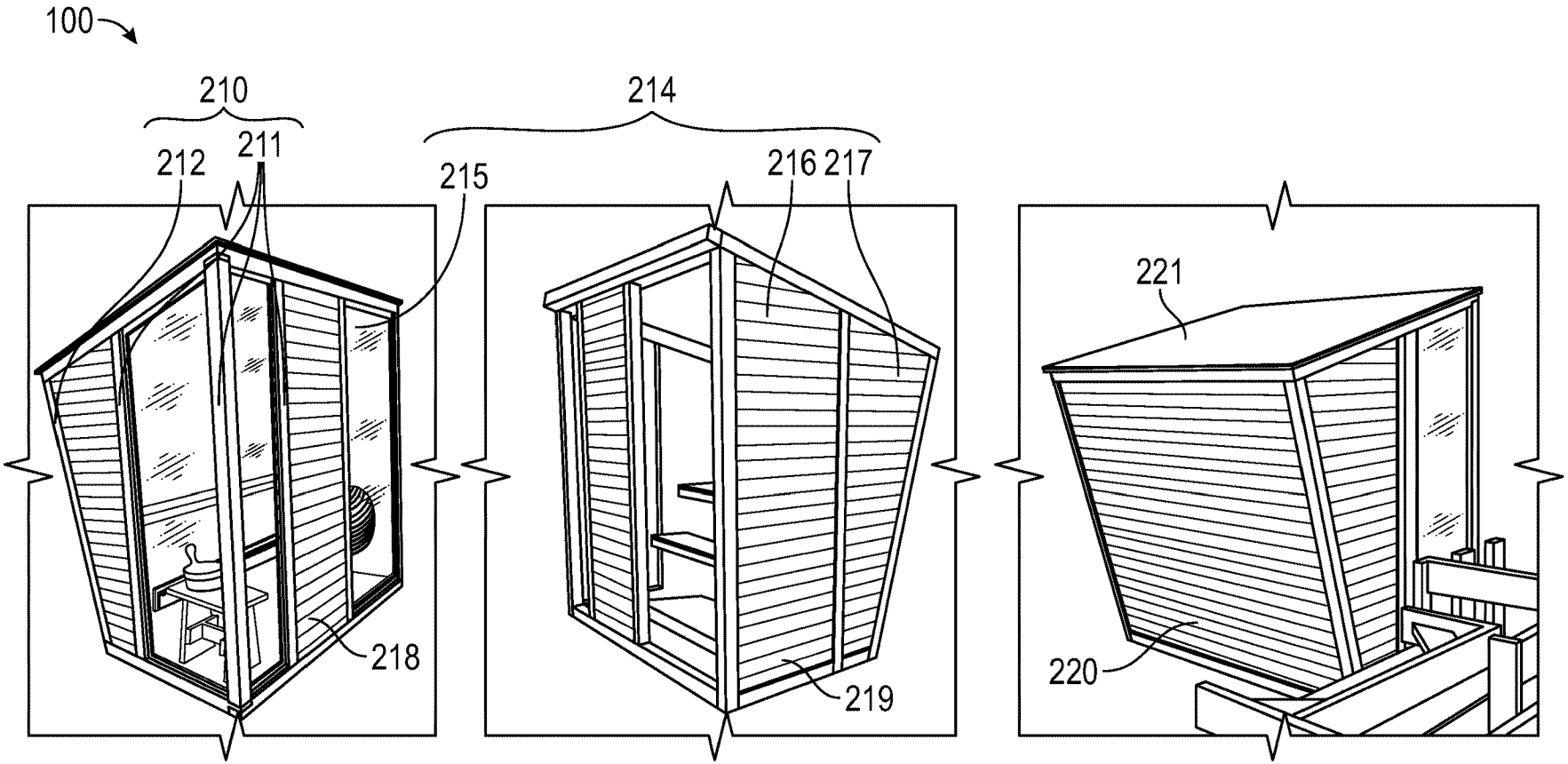
FIG. 1 depicts different viewpoints of a prefabricated/modular sauna.

FIG. 1 depicts different viewpoints of a prefabricated/modular sauna 100. The sauna 100 may include beams 203/222, posts 210 and panels 214, 220, and 221, as discussed herein. In some case, a structural integrity of the sauna 100 may be primarily based on a framework of interconnections and interactions of the beams 203/224, posts 210, and panels 214, 220, and 221. In this manner, the sauna 100 may be assembled with no or minimal mechanical connectors (e.g., straps, bolts, screws). In some cases, the sauna 100 may use mechanical connectors for certain components (e.g., for uplift considerations) and the like, in view of considerations such as wind or weather considerations required for exterior buildings (such as demanded by code regulation). However, generally, the structural integrity may be ensured by posts and beams that engage by notches (to resist lateral motion at end points of posts), lap joints (to resist lateral motion at intersections of beams) and pegs (to engage beams/posts in vertical alignment). Thus, a portion (e.g., a majority) of the structural weight of panels (and sauna control elements) may be supported by the posts and beams. Moreover, panels may be fixed by dados cut into posts/beams and supply some structural rigidity to wind or environmental interaction. In this manner, the sauna 100 may employ few to no usual mechanical fasteners for saunas 100.

In some cases, the dados of posts and beams may accommodate the panels, so as to align panels with dados of adjacent posts and beam (e.g., a next nearest post or beam). In some cases, the panels may be fit in dados in a near pressure fit manner (e.g., a thickness of a panel may be within a threshold tolerance of a width a dado, such that it has a small degree freedom of movement). In some cases, the panels may be formed of various materials, such as wood, glass or other materials (such as metal and the like).

In some cases, (1) when a panel is formed of wood and (2) the panel may be too large to ship economically and/or is too large for two people to handle comfortably, the sauna 100 may include the panel in parts joined using a tongue and groove to seamlessly put more than one panel together (such as in a back panel and top panels). In this manner, transport of de-assembled saunas may be conducted with reduced risk of damage, and users may assemble the sauna without undue exertion or risk of injury.

In some cases, the sauna 100 may include a sauna assembly in a single panel (a control panel). The sauna assembly may include at least a heater and controls for the heater. In some cases the sauna assembly may also include electrical connection (e.g., in the case of electrical heater). In some cases, the sauna assembly may include additional features, such as lights, a charging port, and the like. As the sauna assembly is pre-built into the control panel, an installation process for a user may be easier (e.g., only a certain electrical outlet installed) and transport and assembly of the sauna 100 may be less complicated. For instance, as all components of the sauna assembly may be wired into the control panel with an outlet, all the end user must do to finish an installation (after assembly, as discussed herein) is to connect the electrical outlets.

In some cases, an exterior panel on a roof of the sauna 100 may be formed of rubber. In some cases, because of the size for transport or for user assembly, the exterior panel may be formed in parts (e.g., two parts, such as halves) that are joined/hinged. For instance, the parts of exterior panel may be connected a rubber roofing material, so it can be folded in half for handling and shipping and installed on top panels of the sauna. In this manner, the transport of the de-assembled sauna may avoid damage and/or excess transport costs.

In some cases, a floor panel of the sauna 100 may be retained (e.g. supported and secured from lateral movement) by base beams. For instance the floor panel may be inserted in the base frame of base beams.

In some cases, the base beams and top beams may be joined using lap joints (e.g., ends that interlace or overlap each other). Lap joints may provide structural rigidity for adjacent beams, thereby transmitting compression and tension primarily via beams and posts, instead of primarily via the panels. In some cases, the beams may include notches to secure posts from lateral movement (e.g., axially along beams). In some cases, the posts may be secured from lateral movement (e.g., transversely from a longitudinal axis of a beam) by pins (or, optionally, screws, bolts, or other mechanical connectors).

Using combinations of dados, notches, and lap joints on beams and posts, the sauna 100 may reduce assembly and transport complexity, while providing structural rigidity and ease of maintenance. For instance, as beams and posts provide (a significant portion) of structural rigidity, the panels may perform humidity control (e.g., the sauna is designed to breathe) while offering a tolerance level for changes over time (e.g. due to humidity and heat cycling). In the case of glass panels, the posts/beams may provide sufficient structural rigidity to avoid stressing the glass panels, while the glass panels interacting with the dados may provide humidity and heat control of the sauna envelope.

In some cases, the sauna 100 may include a base frame 201; a floor panel 209; a plurality of posts 210; a plurality of panels 214; a roof frame 222; and a roof panel 221.

In some cases, the base frame 201 may form a base footprint 202. The base frame 201 may include a plurality of base beams 203 that form a base perimeter 202 (e.g., with lengths L1, L2) of the base footprint 202. The base frame 201 may have base beam intersections 204 between adjacent base beams 203. Each base beam intersection 204 may be formed of a base beam lap joint 205 and a base beam pin 206. The lap joint 205 may provide secure adjacent base beams 203 from lateral movement (e.g., relative to each other). The base beam pin 206 may secure the base beams from transverse lateral movement, and, optionally, secure posts from lateral movement with respect to the base beams. In some cases, the base beam intersections 204 may also include notches to secure the posts in relative location to the base beams.

In some cases, each base beam 203 of the plurality of base beams may include at least one base beam dado 208 and at least one base beam notch 207 on a top face of the base beam. The notch 207 (e.g., with a pin), as discussed above, may secure posts from lateral movement with respect to the base beams, while the base beam dado 208 may secure panels from lateral movement. As discussed herein, the posts and lap joints may have holes to receive a pin (or, in some cases other mechanical connector).

In some cases, the floor panel 209 may be configured to be disposed on and secured from lateral movement by the base frame 201. For instance, the floor panel 209 may have a smaller footprint than the base footprint 202 (e.g., within a tolerance of relative sizes), so as to engage the base frame with or without a gap distance from the floor panel 209 and the base frame.

In some cases, the plurality of posts 210 may include a first set 211 of the plurality of posts and/or a second set 212 of the plurality of posts. The first set 211 of the plurality of posts may be respectively set in a first set of base beam notches of the base beams and orientated in a first direction. The first direction may be about 90 degrees from the base beams in a substantially vertical manner relative to gravity.

The second set 212 of the plurality of posts may be respectively set in a second set of base beam notches of the base beams and orientated in a second direction. The second direction may be about 105 degrees from the base beams in a substantially sloped manner relative to gravity. For instance, the second direction may be any number of degrees between 70 to 120 degrees with respect to gravity.

The selection and placement of the first set 211 of the plurality of posts and/or the second set 212 of the plurality of posts may be configured to achieve different design choices, such as events, or purpose of the sauna 100. Based on relative orientations of posts and floor and ceiling footprints, the sauna 100 may be outfitted with corresponding panels to fit the posts and beams.

In some cases, each of the plurality of posts may include at least one post dado 213. A post dado 213 may secure an adjacent panel (e.g., a panel inserted in the dado). In some cases, some posts may include 2 or more dados (e.g., on respective faces of the post). As depicted in, e.g., FIG. 1, the posts may be generally rectangular or square in shape, but may be any shape, such as square, rectangular, circular, semi-circular, or polygonal. In some cases, each of the plurality of posts may be secured in respective base beam notches 207 using a base post pin 206. The base post pin 206 may be inserted into a hole of the base beam notch and a hole on a bottom face of the plurality of posts.

In some cases, the plurality of panels 214 may include any of combinations of: a first set 215 of the plurality of panels, a second set 216 of the plurality of panels, and/or a third set 217 of the plurality of panels. In some cases, the first set 215 of the plurality of panels are rectangular. In some cases, the second set 216 of the plurality of panels are trapezoidal. In some cases, the third set 217 of the plurality of panels are polygonal with four sides that are not parallel to any other side. The selection and placement of the types of panels may be designed in accordance with posts and beams, so as to engage dados on posts and beams and ensure a sufficient fit (e.g., for humidity and heat control of the sauna 100 envelope).

In some cases, a first panel 218 (e.g., of the first set of the plurality of panels) may include a door 218A. In some cases, the door 218A may be designed to open one way or another (or reversed based on hinges, and rotating the panel). In some cases, the first panel 218 may be pre-assembled with a panel/door/hinges combined with posts.

In some cases, a second panel 219 (e.g., of the second set of the plurality of panels) may include a sauna assembly 300. The sauna assembly 300 may include: a heating system 302, an electrical system 304, and an electrical outlet 310.

In some cases, the heating system 302 may be disposed on an interior wall of the second panel facing an interior volume of the prefabricated sauna 100. In some cases, the electrical system 304 may be (1) disposed on the interior wall of the second panel, (2) disposed in an internal volume of the second panel, or (3) disposed on an exterior wall of the second panel. The electrical system 304 may be connected to the heating system 302 (e.g., to control and provide power to the heating system 302). In some cases, the electrical outlet 310 may be disposed on the exterior wall of the second panel facing the exterior of the prefabricated sauna and connected to the electrical system 304. The electrical outlet 310 may be connected to a local (e.g., a power grid of a house or compound) or remote (e.g., generator) electrical system, so as to power electrical components of the electrical system 304.

In some cases, the plurality of panels may be respectively secured in post dados of the posts and base beam dados of the base beams. In this manner, the panels may be secured from movement, while providing humidity and heat control of the interior envelope of the sauna 100.

In some cases, the roof frame 222 may form a roof footprint 223 (having lengths L3, L4). The roof frame 222 may include a plurality of roof beams 224. The roof beams 224 may form a roof perimeter of the roof footprint. The roof beams 224 may have roof beam intersections 402 between adjacent roof beams (like the base beams).

Each roof beam intersection 402 may be formed of a roof lap joint 406 and a roof pin (not depicted, same as base beam pin). Each roof beam of the plurality of roof beams includes at least one roof beam dado 208 and at least one roof beam notch 404 on a bottom face of the roof beam. Thus, in this manner, each of the plurality of posts are secured in respective roof beam notches using a roof post pin that is inserted into a hole of the roof beam notch and a hole on a top face of the plurality of posts. The plurality of panels may be respectively secured in roof beam dados of the roof beams.

In some cases, the roof panel 221 may be configured to be disposed on and secured from lateral movement by the roof frame. For instance, the roof panel 221 may form a ceiling of the sauna 100, to control humidity and heat within the envelope of the sauna 100.

In some cases, the base footprint is a square or rectangle. In some cases, the floor panel has at least twenty square feet of floorspace on an interior volume of the footprint. In some cases, the roof footprint is a square or rectangle. In some cases, the roof footprint is greater than the base footprint.

In some cases, the plurality of panels include at least some panels formed of wood and at least some panels formed of glass. In some cases, the wood panels may be used for structural purposes (e.g., to support a sauna assembly or too large for efficient transport), while glass panels may be provided for aesthetic reasons.

In some cases, the second panel is prepackaged with the sauna assembly. In this manner, installation/assembly may be easier for end users. Moreover, packaging of sauna assembly components may be reduced. In some cases, the sauna assembly may include a control interface 312. In some cases, the control interface 312 may be a part of the heating system, or separate from the heating system and separately connected to the electrical system. In some cases, the control interface 312 may be disposed on an exterior of the second panel. In some cases, the control interface 312 may be disposed on an interior of the second panel. In some cases, the control interface 312 may be a digital or manual control. In the case of a digital control, a user may connect a personal device (e.g., a mobile device) via wired or wireless connectivity to control the sauna 100. In some cases, the sauna assembly includes a lighting fixture 306. In some cases, the lighting fixture 306 is disposed in an interior facing dado of the second panel or post associated with the second panel. In some cases, the second panel is prepackaged with posts associated with the second panel. In some cases, the sauna assembly includes one or combinations 308 of: an outlet, a speaker, or an entertainment system, disposed on the interior wall.

In some cases, the door 218A extends from a floorspace to a roof. In some cases, the door 218A extends from a floorspace to a header. In some cases, the door 218A is reversable configured to open outward in a first rotation or a second rotation.

In some cases, the roof panel is secured by rails along lateral sides of the prefabricated sauna 224. For instance, the rails may be formed in the roof beams on the lateral sides of the prefabricated sauna.

In some cases, the roof panel includes a ceiling panel 221. The ceiling panel 221 may be formed in two parts 221A and 221B secured together by a tongue and groove connection 221A-1 and 221B-1. In some cases, the roof panel includes an exterior panel 225 formed in two parts 225A and 225B and connected by a weather resistant material (e.g., rubber, metal, and the like).

In some cases, the panels include a third panel 220 (e.g., of the first set of the plurality of panels). The third panel 220 may be a backwall panel 220. The backwall panel 220 may be formed in two parts 220A and 220A secured together by a tongue and groove connection 220A-1 and 220B-1.

In some cases, corner posts of the plurality of posts may include a first post dado on a first face of the post and a second post dado on a second face of the post. The first face may be adjacent the second face. For instance, the first face may be rotated 90 degrees relative to the second face (e.g., on adjacent faces of a square or rectangular post). In this manner, each corner post may secure adjacent panels using respective dados.

In some cases, back corner posts may have a bottom face that is sloped to about 105 degrees (e.g., 90 to 120 degrees) from an axial direction of the post, so as to cause the second direction to point away from a front of the prefabricated sauna. In this manner, the interior volume may be larger than a structure with straight vertical walls surrounding the base footprint.

In some cases, intermediate posts of the plurality of posts (that is posts not at corners) may include a first post dado on a first face of the post and a second post dado on a second face of the post. In this case, the first face may be opposite the second face. In some cases, some or all of the intermediate posts may have dados on additional faces. In some cases, all of the posts may have dados on each face, so as to swappable with any other post (of similar design).

In some cases, the intermediate posts may have a top face that is sloped to about 105 degrees (e.g., 90 to 120 degrees) from an axial direction of the post, so as to slope upward from a back to a front of the prefabricated sauna. In this manner, the intermediate posts may provide a secure support for roof beams that run across the intermediate posts, and providing a designed ridge line for the sauna 100.

In some cases, none, one, some, or all of the base beam pins are used as the base post pins. In some cases, none, one, some, or all of the roof beam pins are used as the roof post pins.

Features & Assembly of Prefabricated/Modular Sauna

Figure 2A:
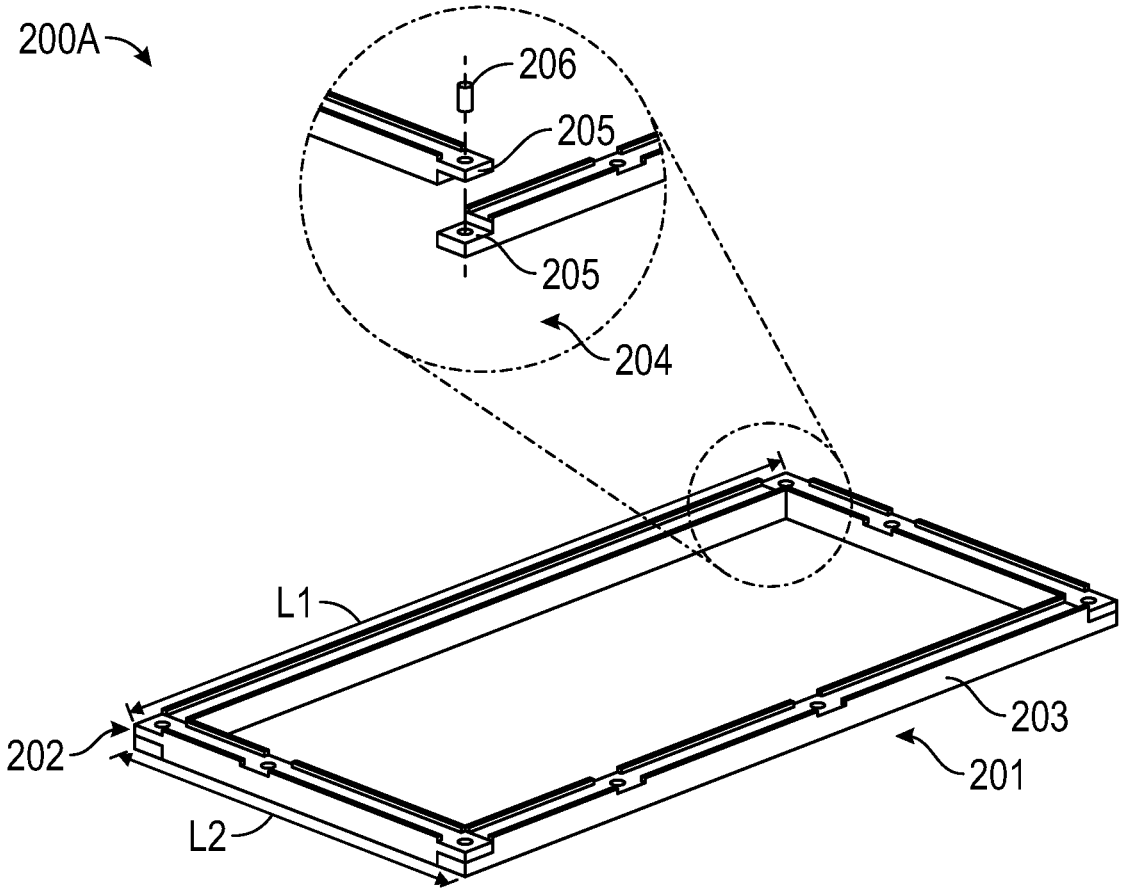
FIGS. 2A-2U depict operations to assemble a prefabricated/modular sauna.
Figure 2B:
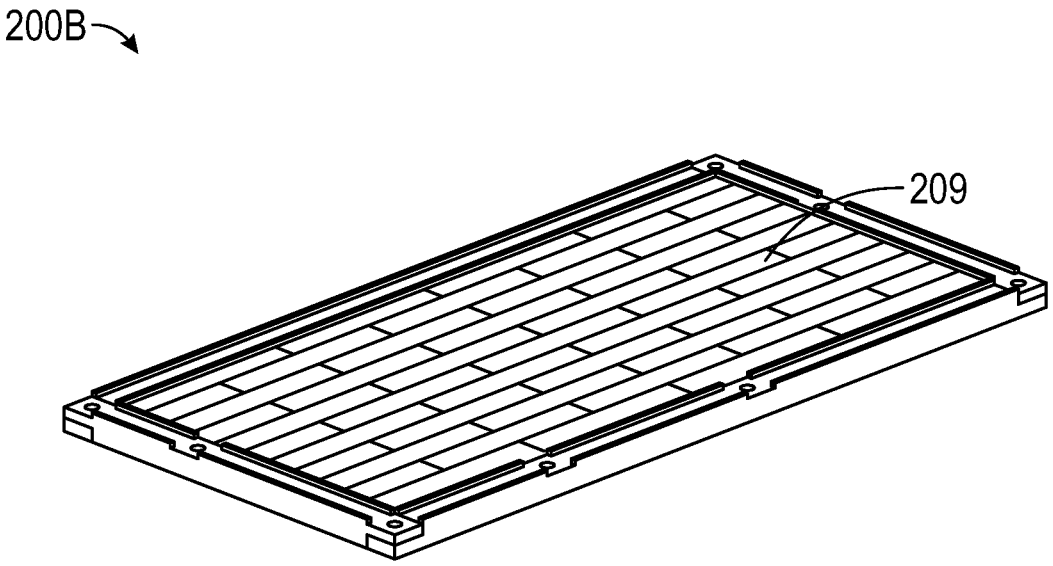
Figure 2C:
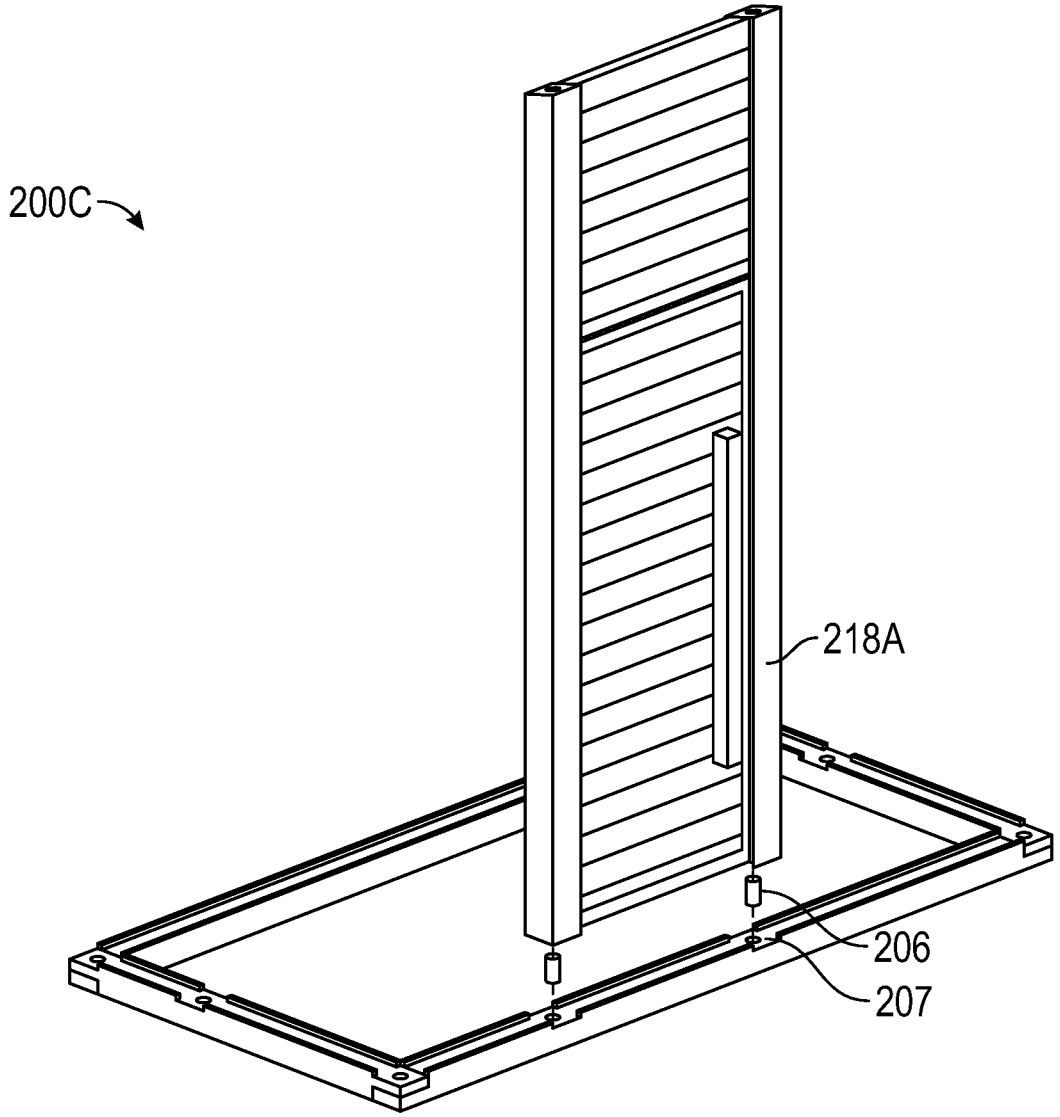
Figure 2D:
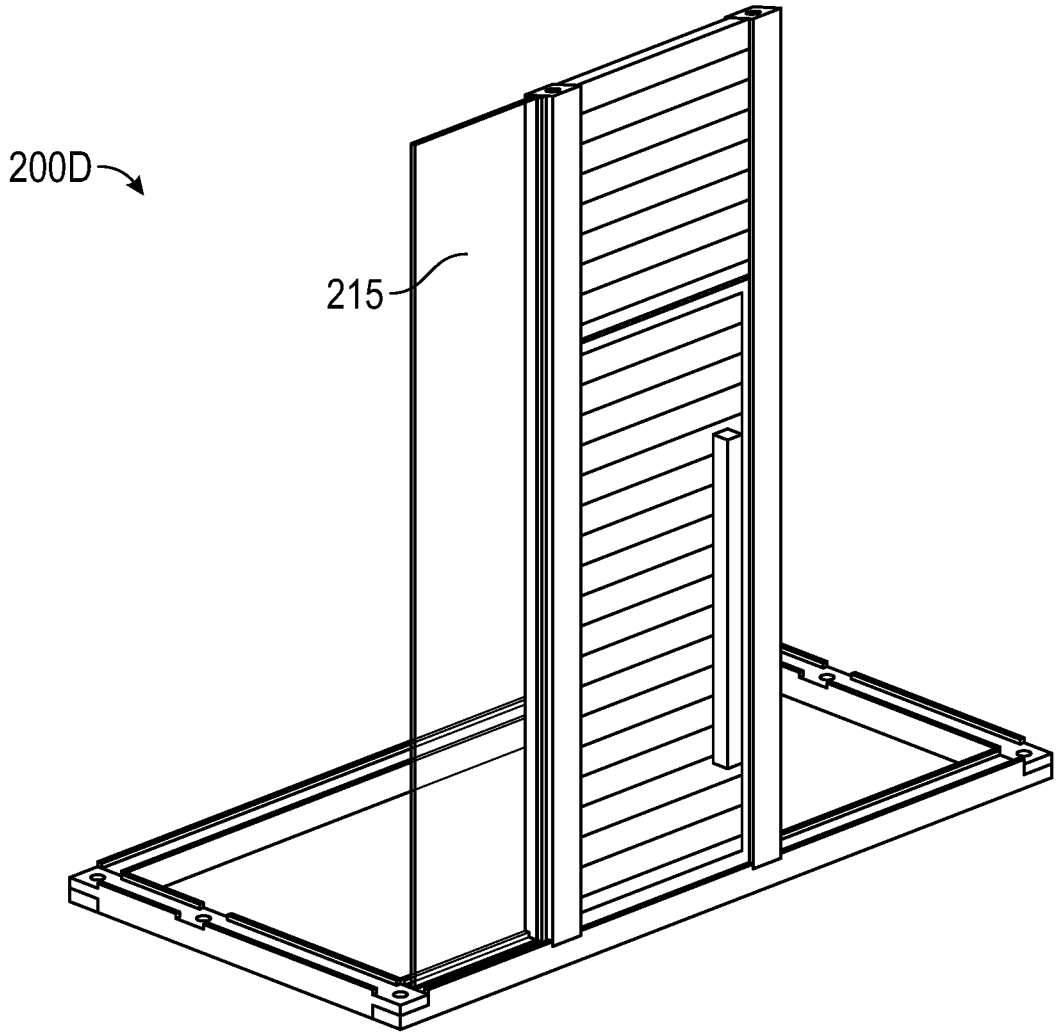
Figure 2E:
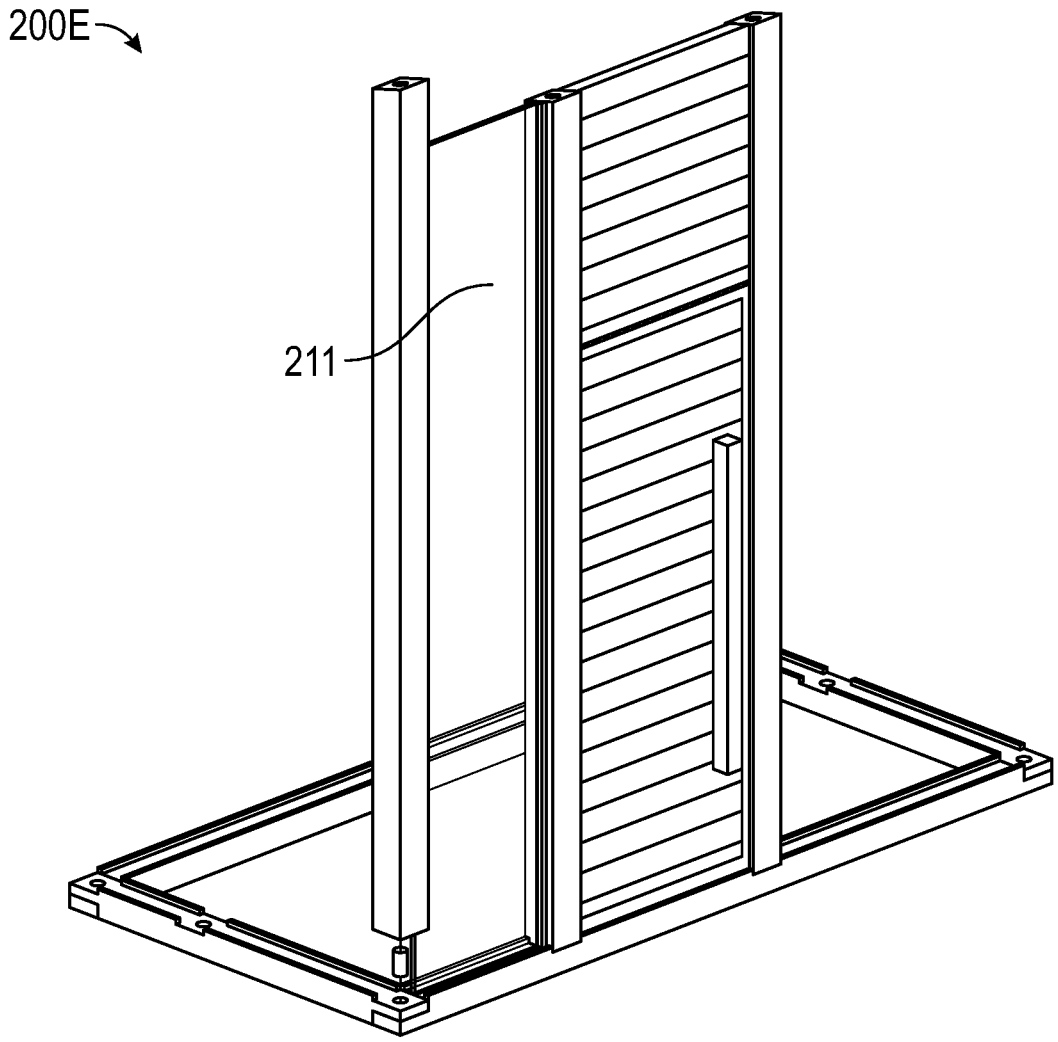
Figure 2F:
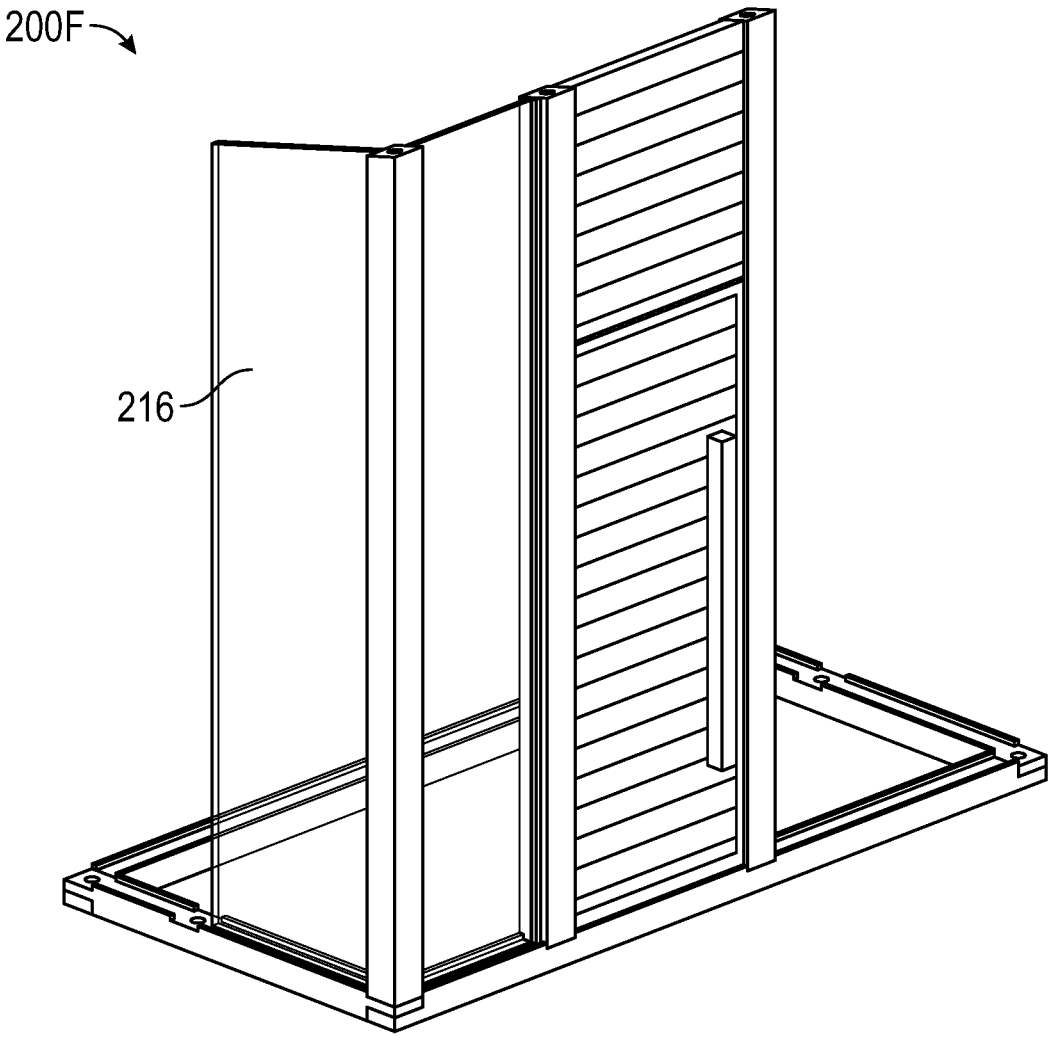
Figure 2G:
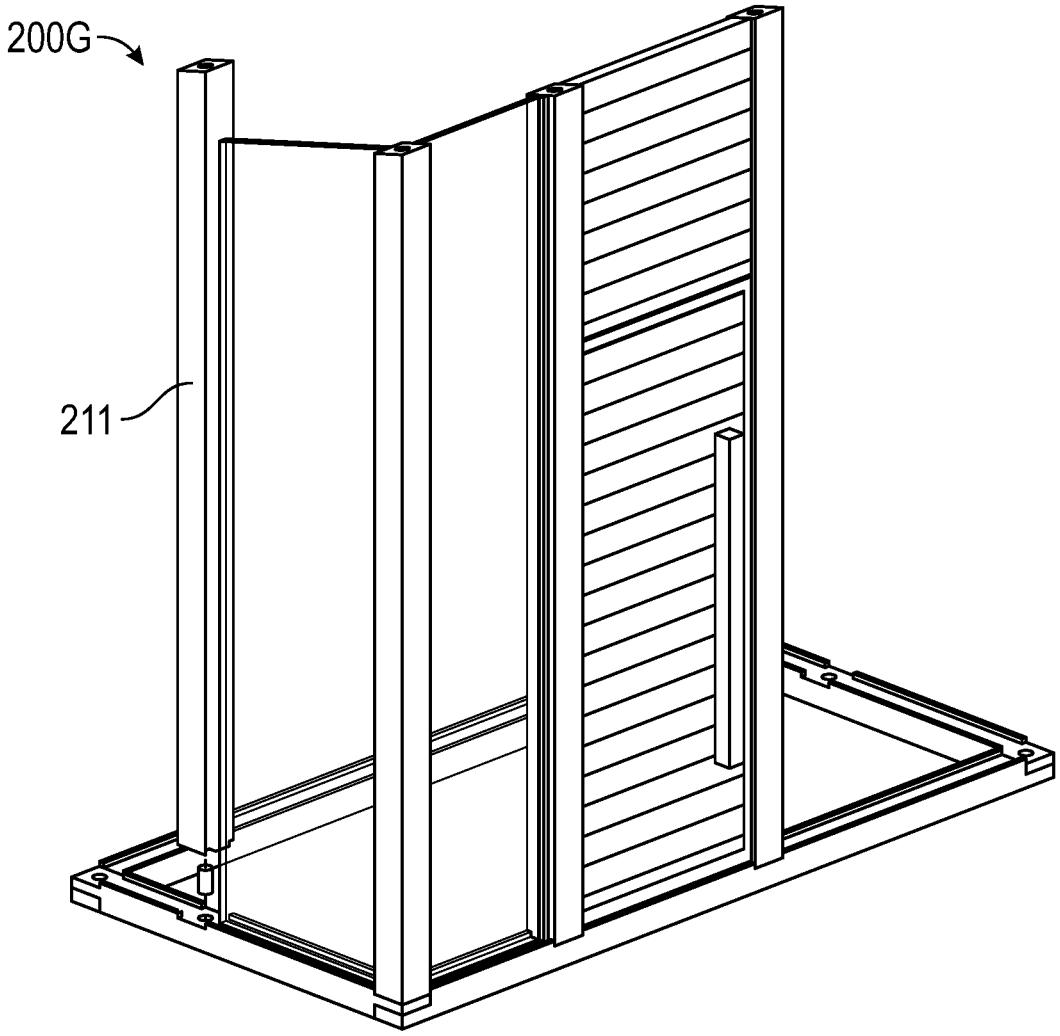
Figure 2H:
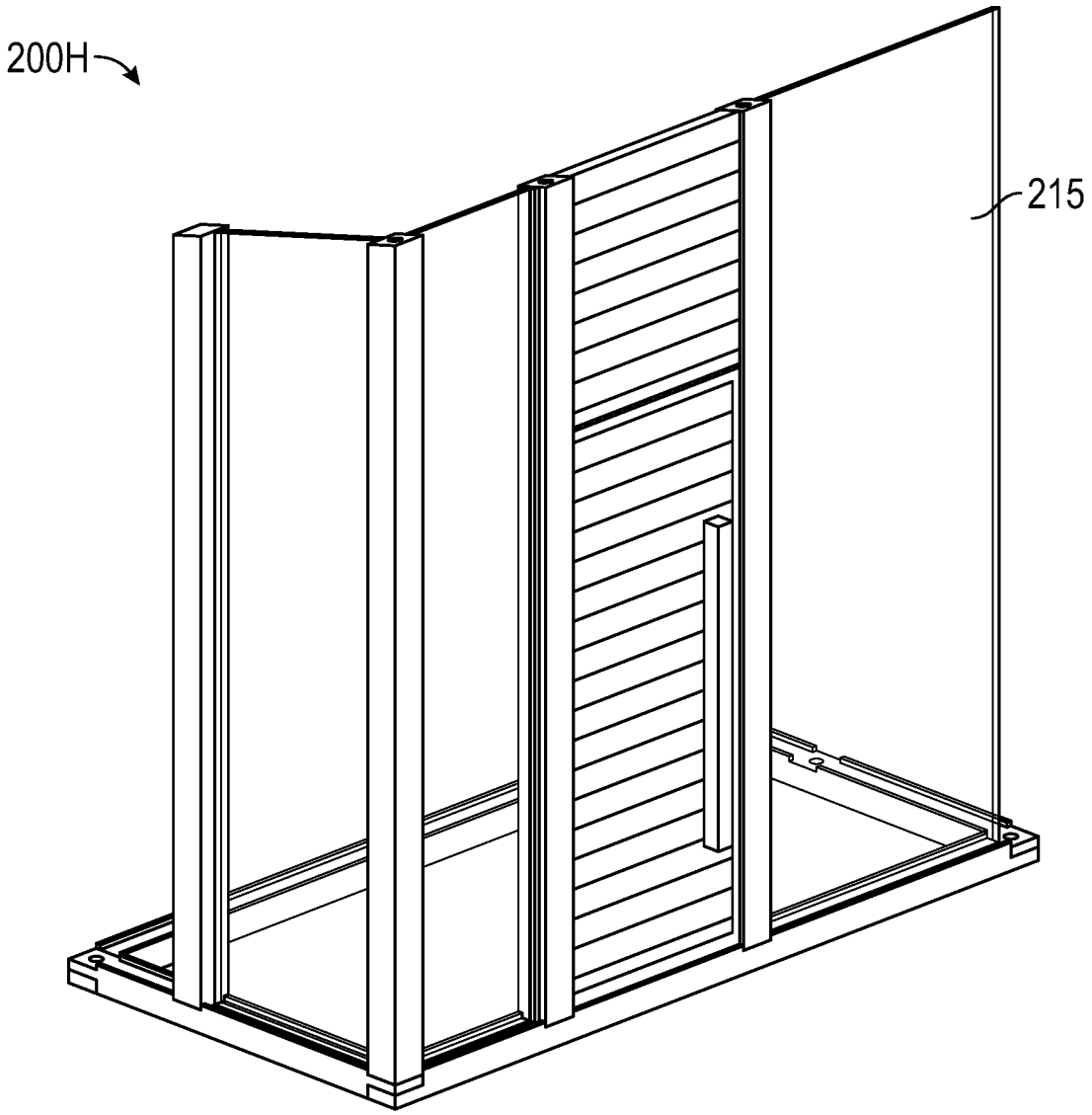
Figure 2I:
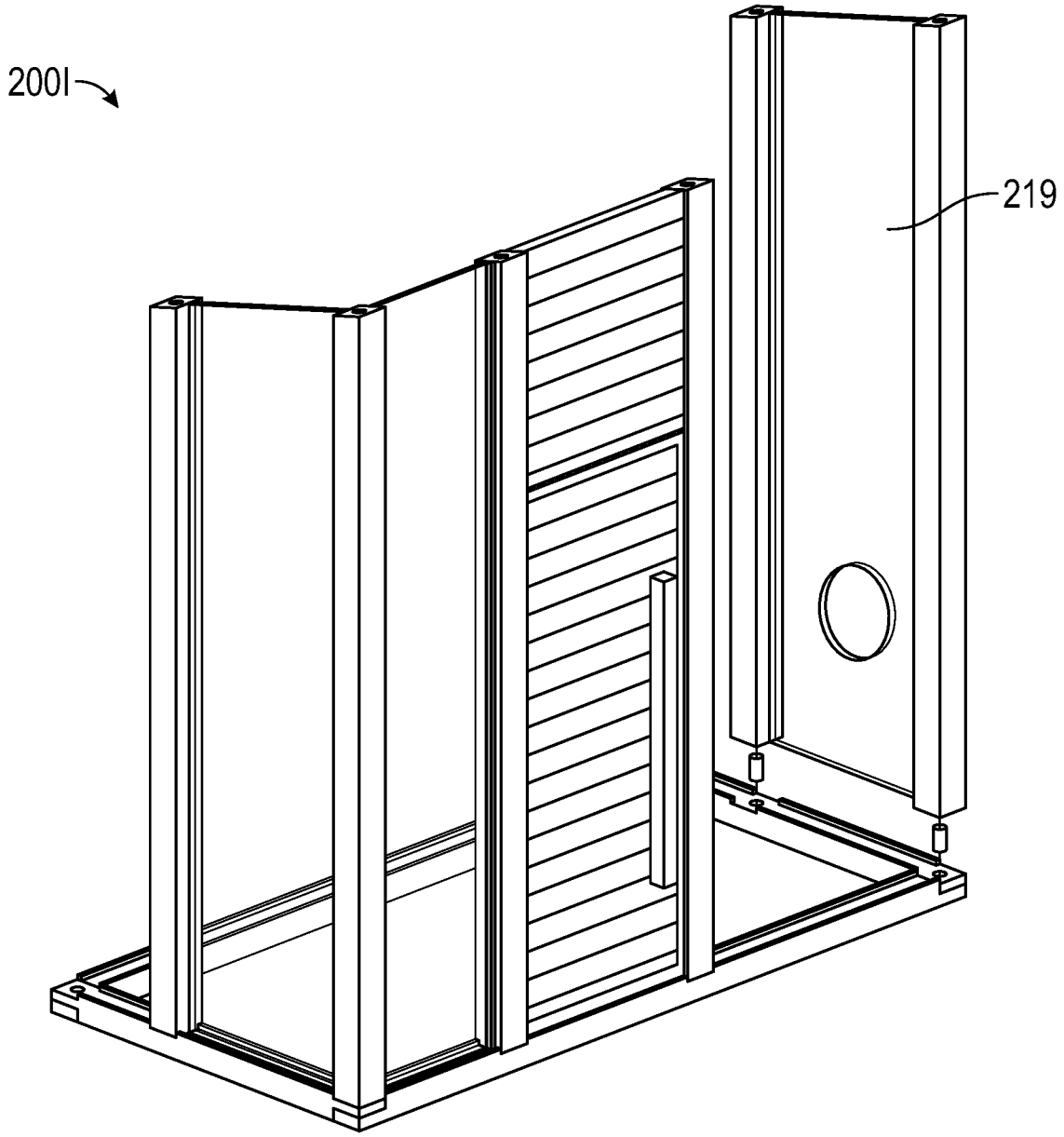
Figure 2J:
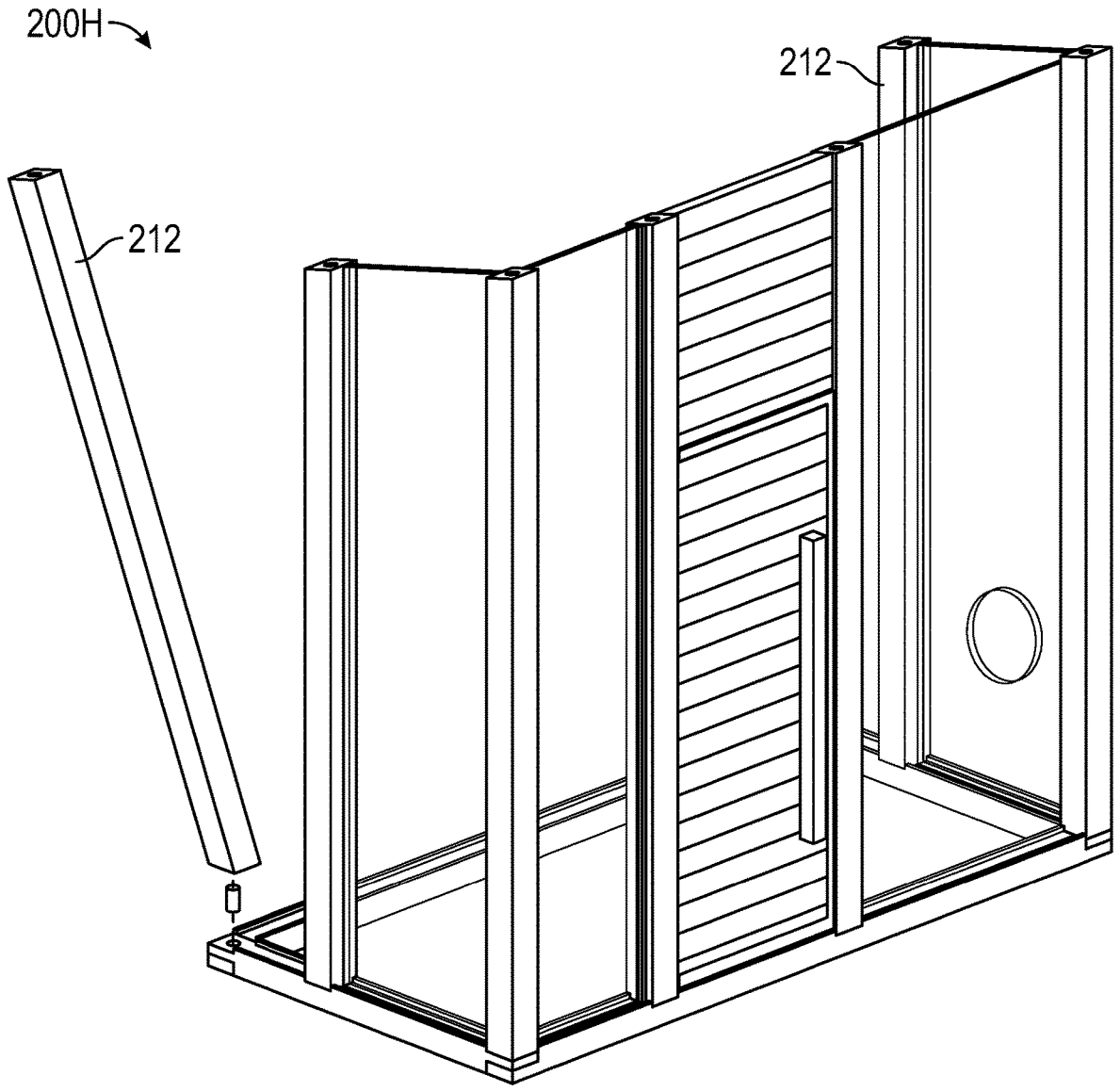
Figure 2K:
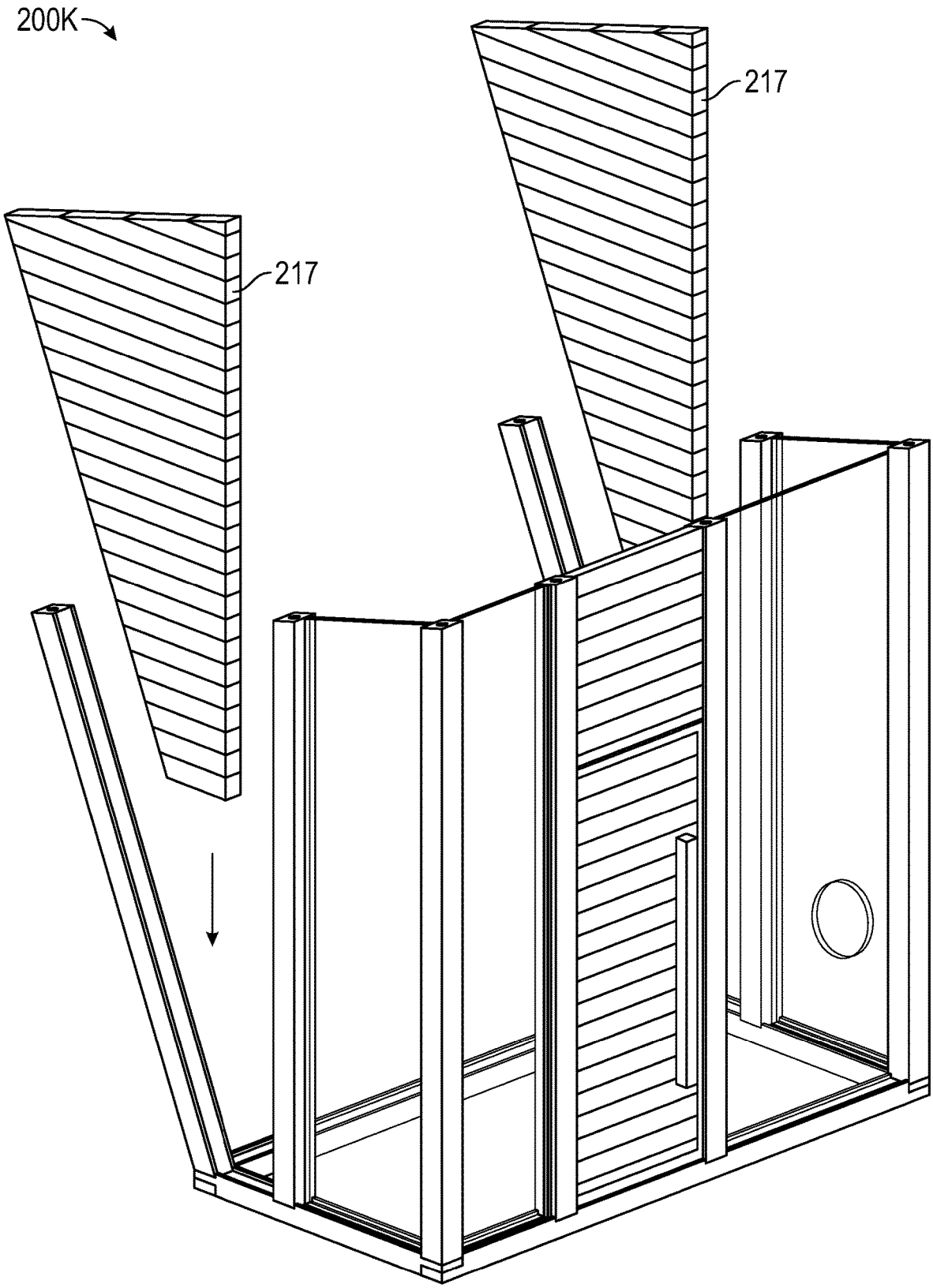
Figure 2L:
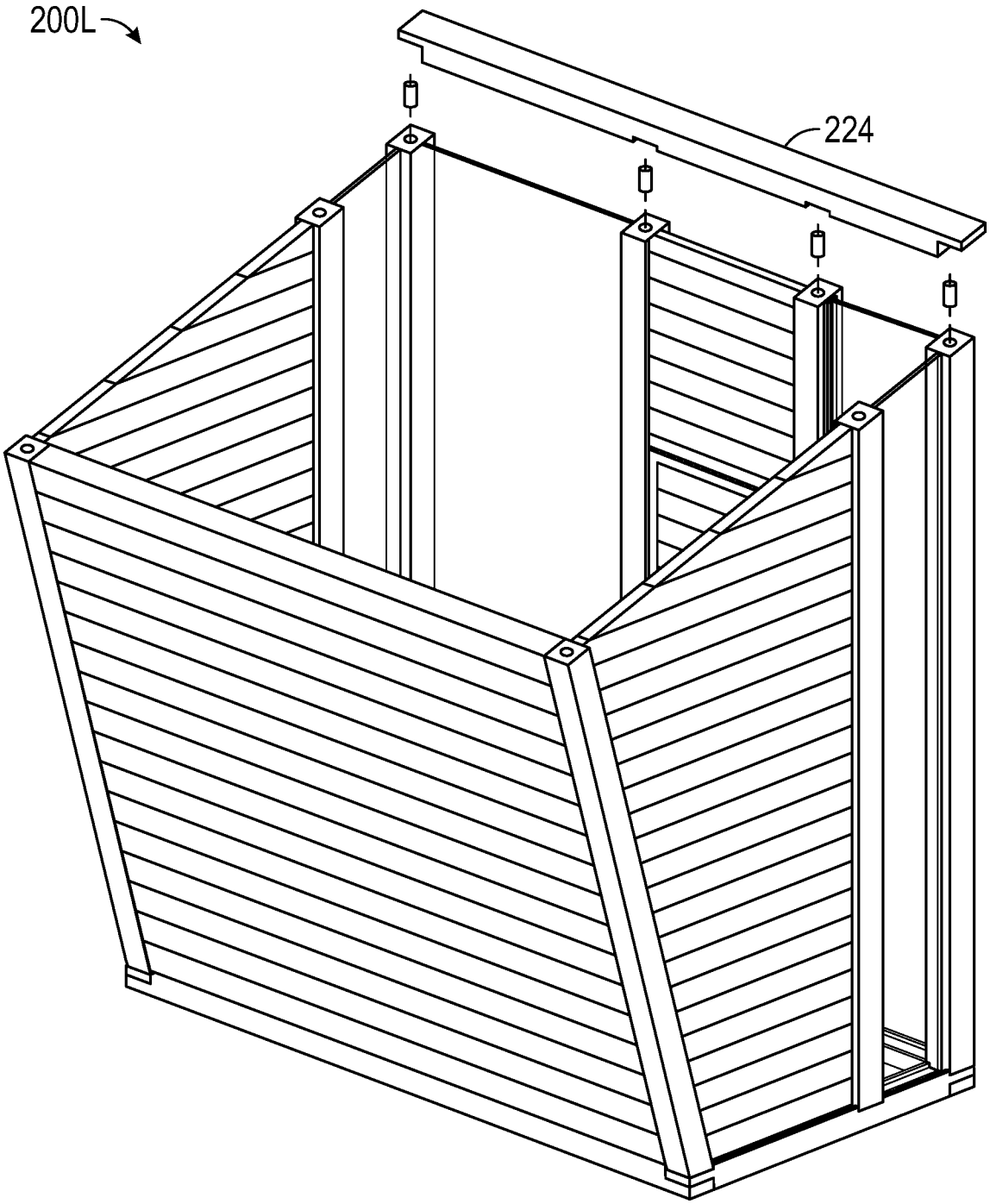
Figure 2M:
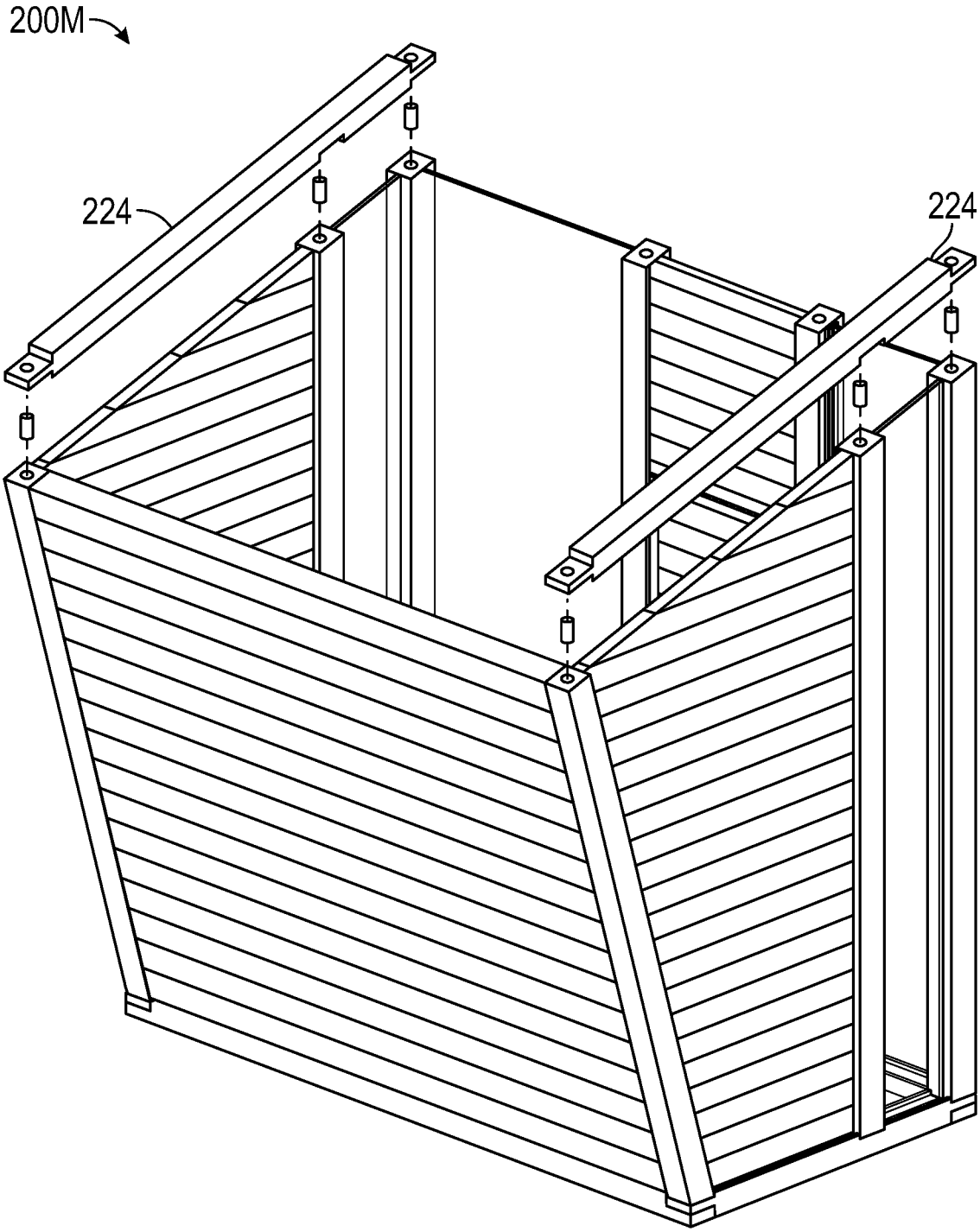
Figure 2N:
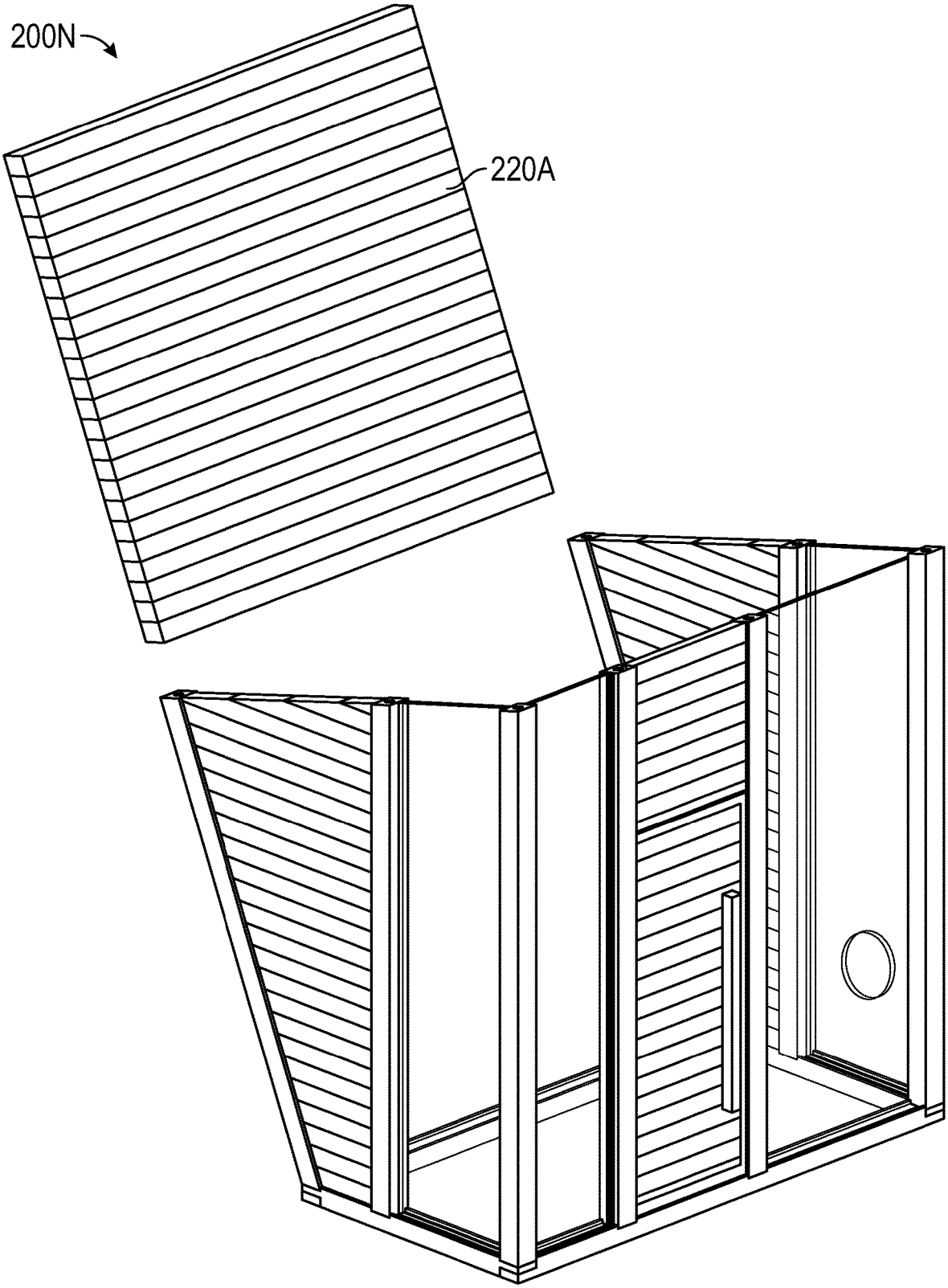
Figure 2O:
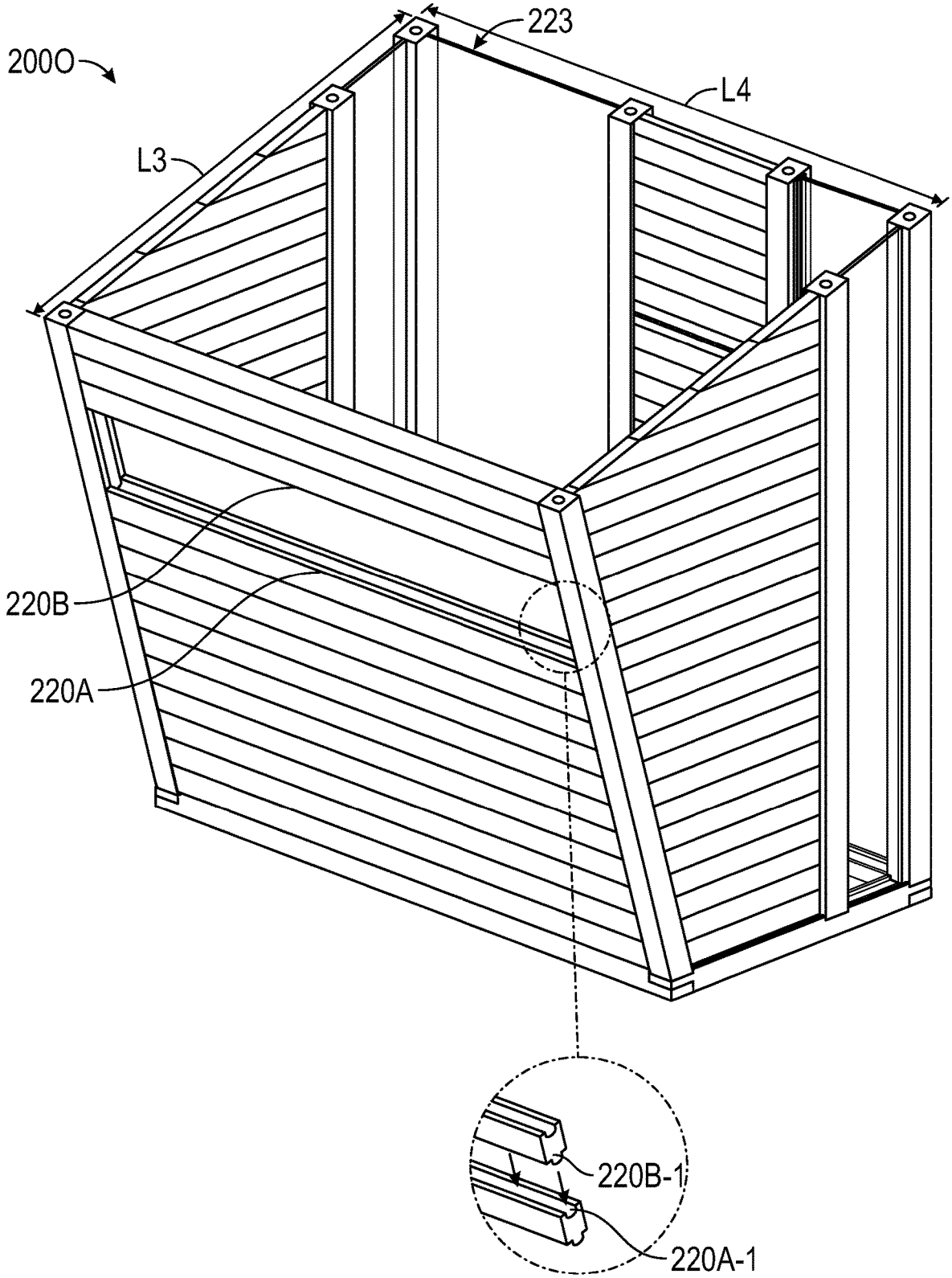
Figure 2P:
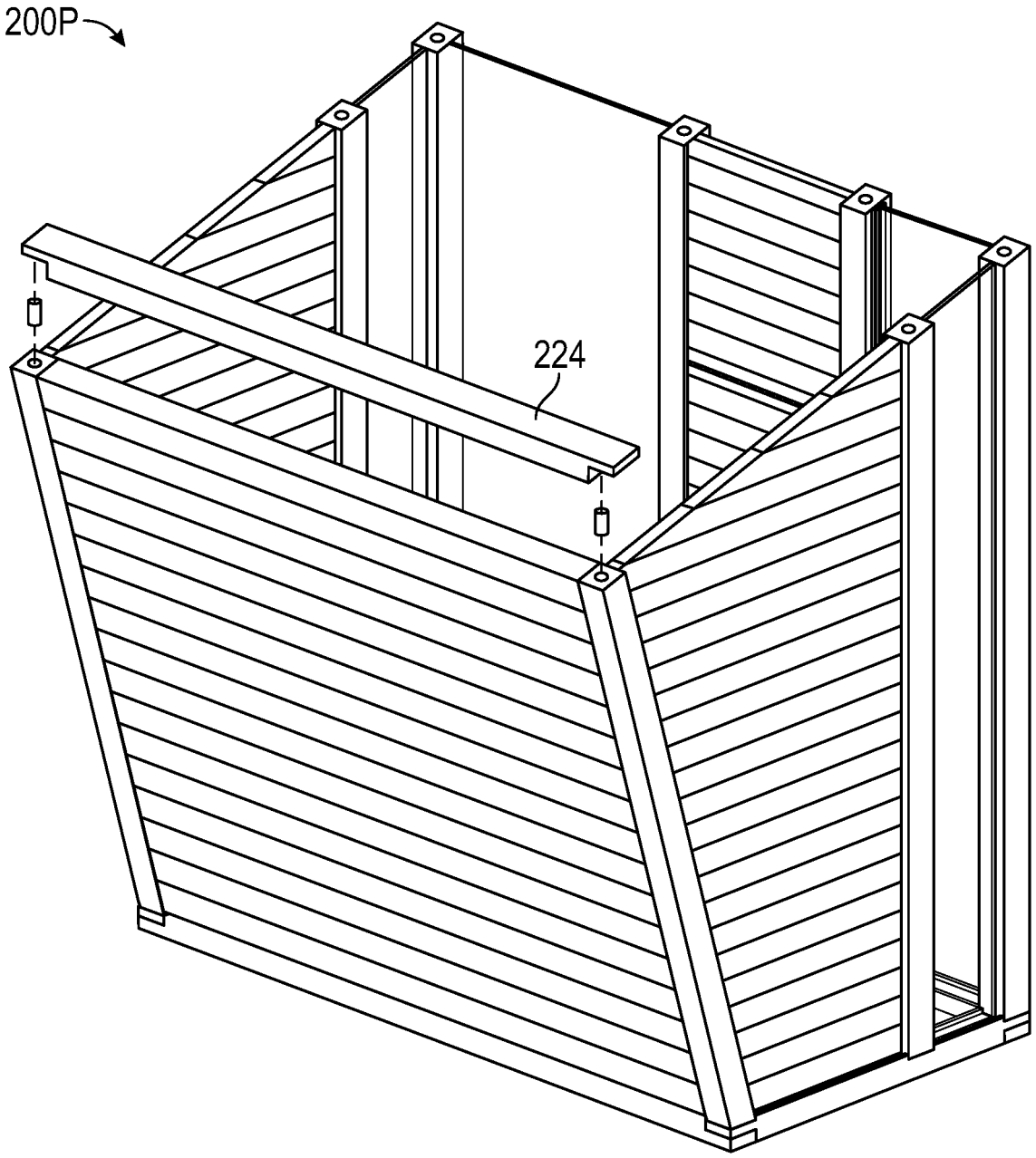
Figure 2Q:
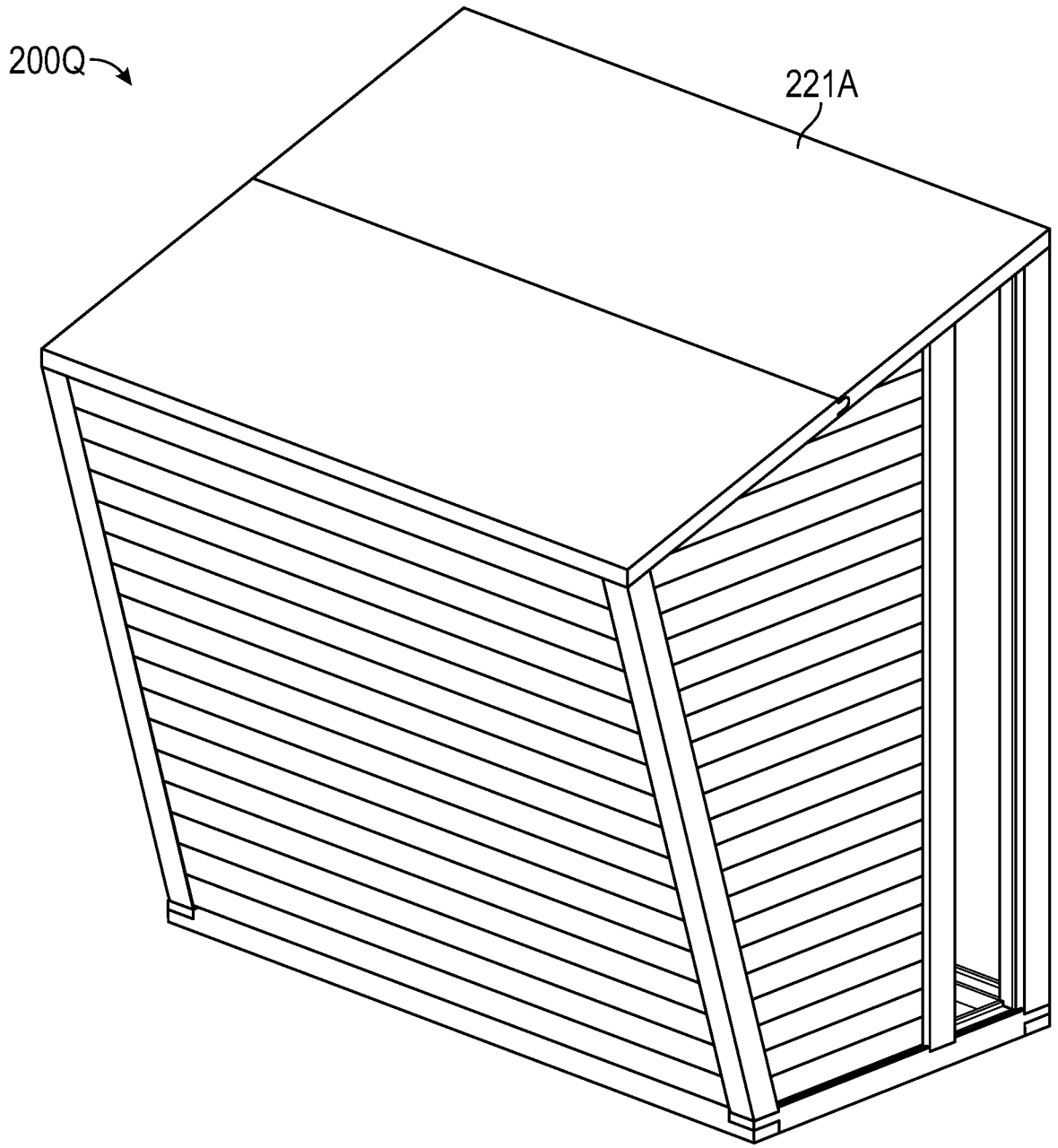
Figure 2R:
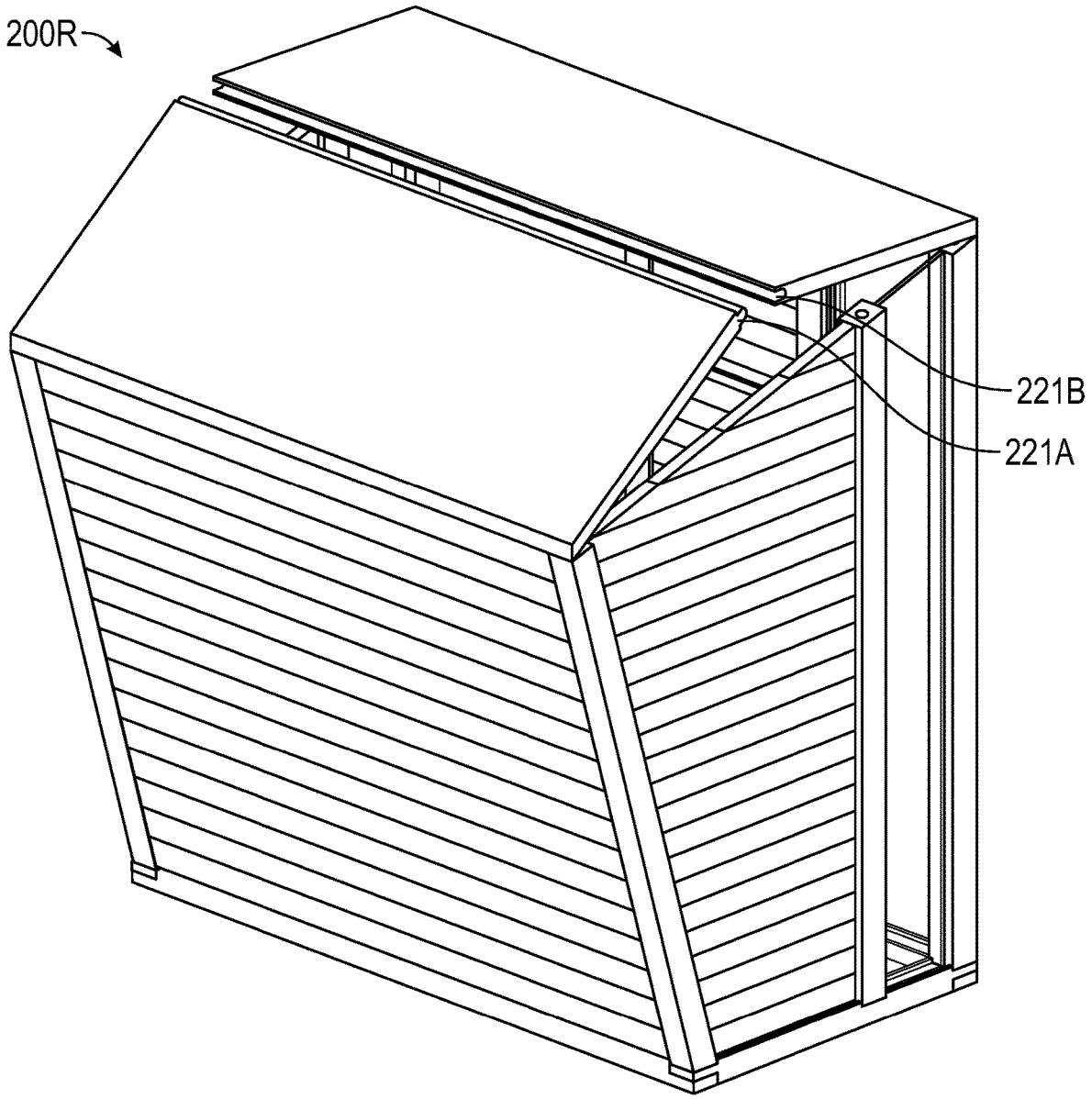
Figure 2S:
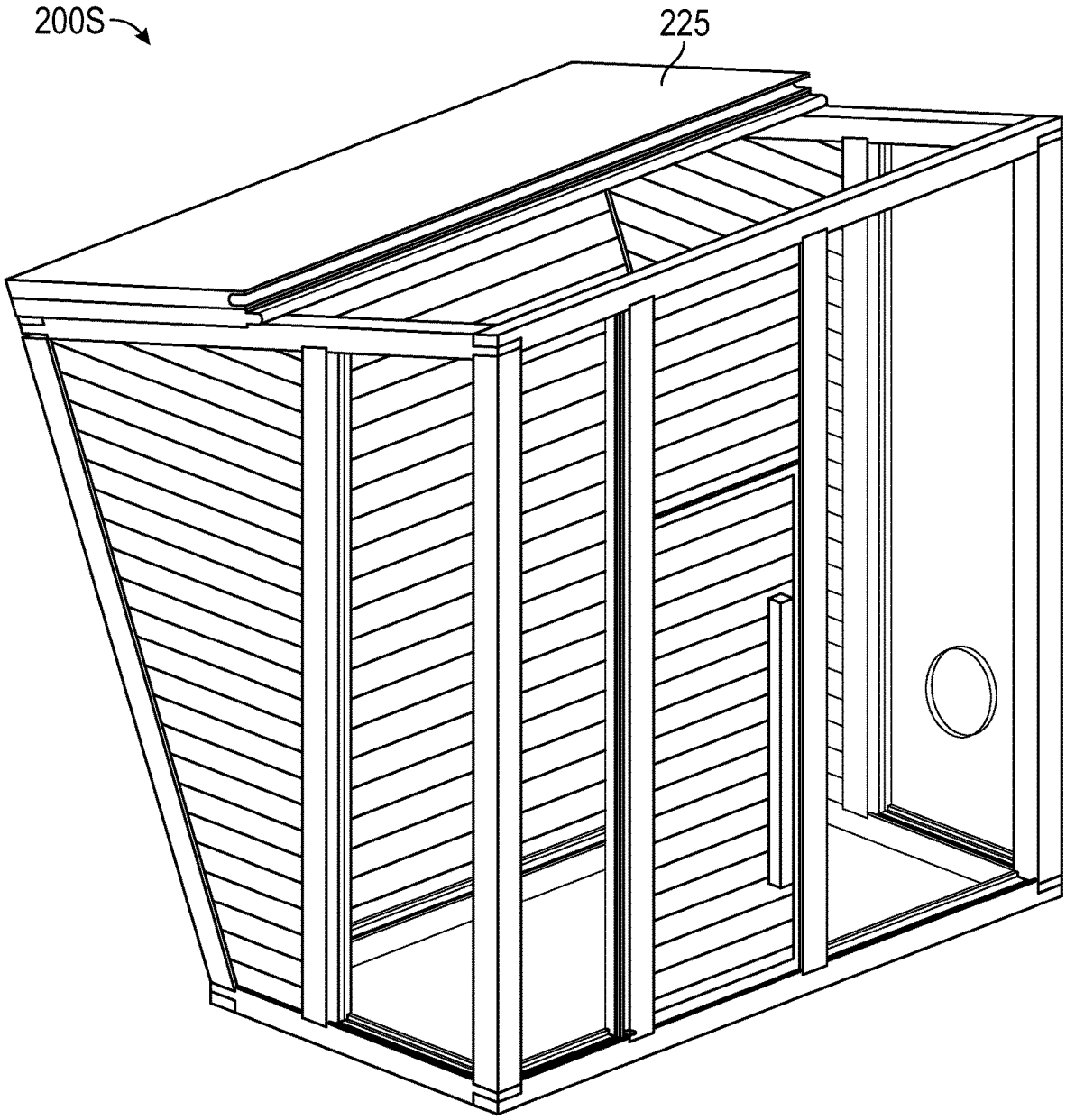
Figure 2T:
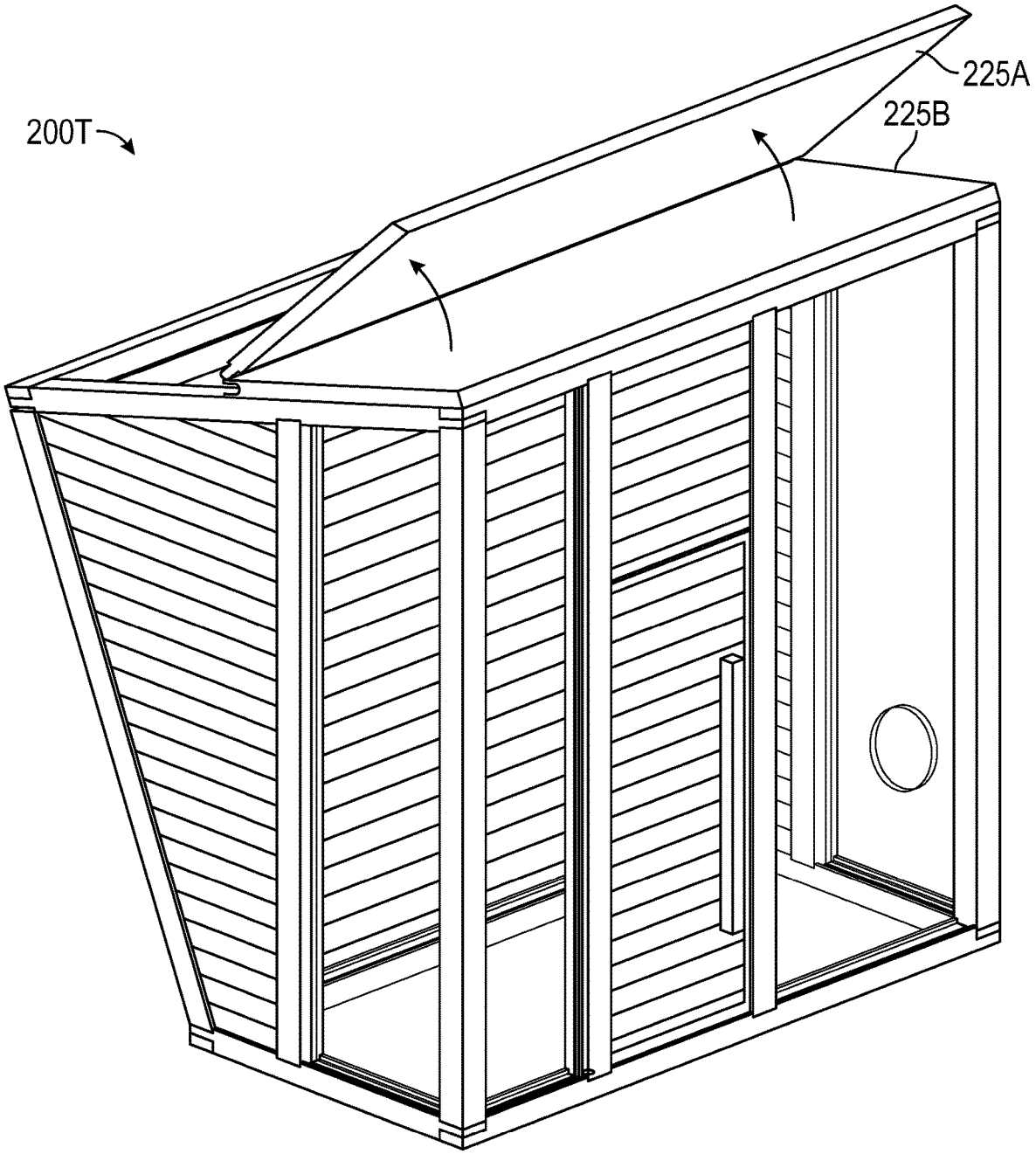
Figure 2U:
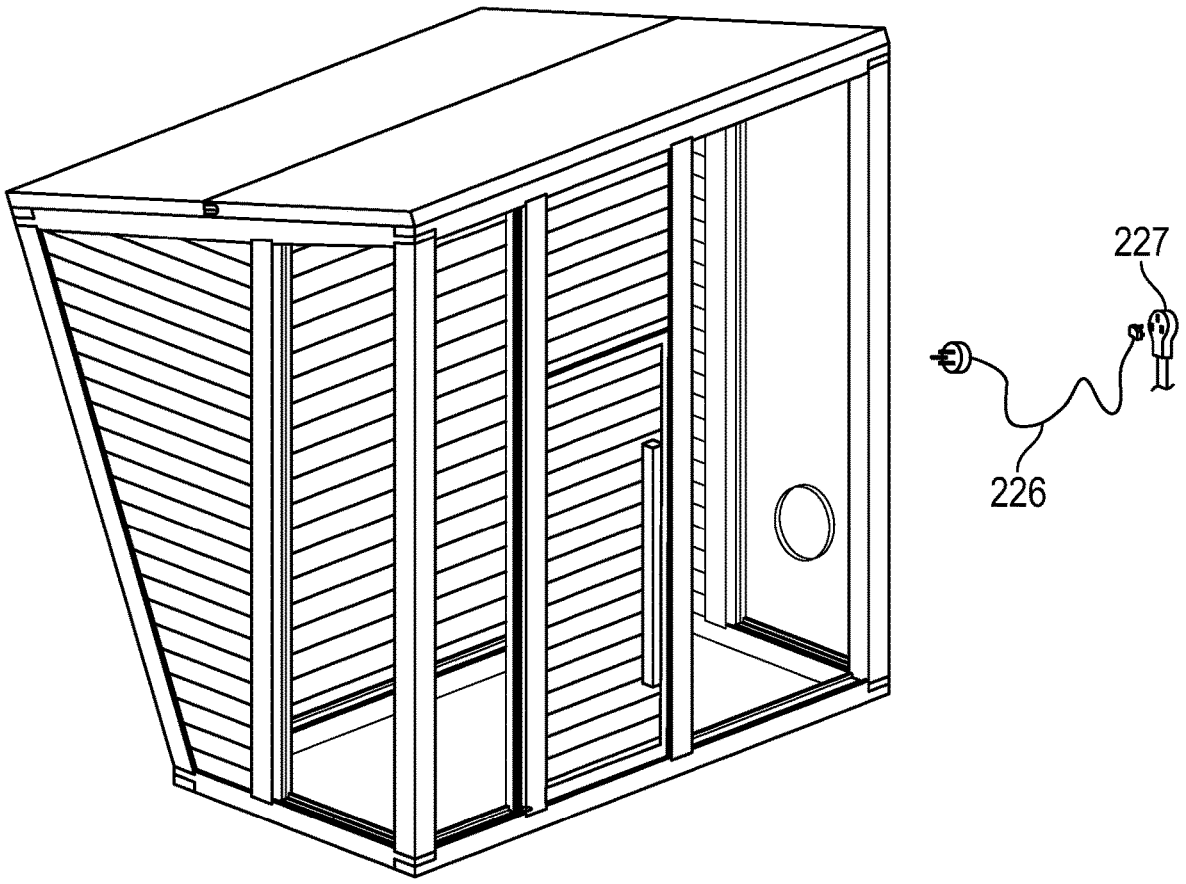

FIGS. 2A-2U depict operations O202 through O240 to assemble a prefabricated/modular sauna, as depicted in diagrams 200A-200U. Features of FIGS. 2A-2U may apply to any of the prefabricated/modular saunas of FIGS. 1, 3, 4, 5A, 5B, 6, 7, 8, and 9.

While the operations O202 through O240 are depicted in a certain sequence, the sequence of operations O202 through O240 may be different (e.g., start in a different location with a different part). Generally, the operations may start with assembling the base frame, and inserting posts and panels that are adjacent each other (or not), so that the structure may support itself with minimal assistance (e.g., a second user or clamps/bands). Generally, the back panels may be added after other portions of the posts and panels are arranged vertically, then a top panel/exterior panel may be placed on top of the structure. Finally, the electrical systems may be connected after the structure is assembled and secured (e.g., by pins in the case of FIGS. 2A-2U, but also, optionally, screws or lag bolts).

In diagram 200A of FIG. 2A, operation O202 may include assembling base frame 201. For instance, the user may prepare a generally flat area and position base beams 203 adjacent each other so that the base beam intersections 204 align, and join the base beams using pins 206. Some of the base beams may have a first portion of a joint, while others may have a second portion of a joint, as discussed herein. As depicted, the base frame has a footprint of general square or rectangular area L1 by L2.

In diagram 200B of FIG. 2B, operation O204 may include inserting floor panel 209.

In diagram 200C of FIG. 2C, operation O206 may include placing door panel 218 with door 218A on pegs in notches 207 with pegs 206.

In diagram 200D of FIG. 2D, operation O208 may include placing first panel type 215 in dado 213 of door panel 218 and dado 208 of base beam.

In diagram 200E of FIG. 2E, operation O210 may include placing first post type 211 in notch 207 with peg 206 and align dado 213 of post with first panel 215.

In diagram 200F of FIG. 2F, operation O212 may include placing second panel type 216 in dado 208 of first post 211 and dado 208 of base beam.

In diagram 200G of FIG. 2G, operation O214 may include placing first post type 211 in notch 207 with peg 206 and align dado 213 of post with second panel 216.

In diagram 200H of FIG. 2H, operation O216 may include placing first panel type 215 in dado 213 of door panel 218 and dado 208 of base beam.

In diagram 200I of FIG. 2I, operation O218 may include placing and aligning (1) the dado 213 of posts of control panel 219 with the first panel type 215 and dado 208 of the base beam and (2) posts of control panel 219 with notches 207 (with pegs 206) for control panel.

In diagram 200J of FIG. 2J, operation O220 may include placing second post types 212 in notch 207 with pegs 206.

In diagram 200*k* of FIG. 2K, operation O222 may include placing panel types 217 in dado 213 of first post type and second post type (e.g., facing each other) and dado 208 of base beam.

In diagram 200L of FIG. 2L, operation O224 may include placing top beam 224 (in this case, front top beam) on front posts with pins 206, and aligning notches 207 on top beam with posts and dado 208 (same as base beam) with panels 215.

In diagram 200M of FIG. 2M, operation O226 may include placing top beams 224 (in this case, side top beams) on side posts with pins 206, and aligning notches 207 on top beam with posts and dado 208 (same as base beam) with panels 216 and 217.

In diagram 200N of FIG. 2N, operation O226 may include placing first back panel 220A in dado 213 of second post type on each side.

In diagram 2000 of FIG. 20, operation O228 may include placing second back panel 220B on the first back panel 220A in dado 213 of second post types on each side, and aligning tongue 220A-1 and groove 220B-1 of back panels 220A and 220B.

In diagram 200P of FIG. 2P, operation O230 may include placing top beam 224 (in this case, back top beam) on posts with pins 206, and aligning notches 207 on top beam with posts and dado 208 (same as base beam) with back panel 220.

In diagram 200Q of FIG. 2Q, operation O232 may include placing a first top panel 221A on top beams 224. For instance, a use may place the first top panel 221A on the top beams 224 then slide the first top panel 221A toward a front of a sauna.

In diagram 200R of FIG. 2R, operation O234 may include placing a second top panel 220B on top beams 224, and aligning tongue 221B-1 and groove 221A-1 of the first top panel 221A and second top panel 221B.

In diagram 200S of FIG. 2S, operation O236 may include placing exterior panel 225 on top panel 220. For instance, the exterior panel 225 may be formed in two parts, including first part 225A and second part 225B (e.g., folded or hinged for transit). The user may slide the (folded) exterior panel 225 to a front of the sauna.

In diagram 200T of FIG. 2T, operation O238 may include unfolding exterior panel 225 and aligning first part 225A and second part 225B with the top panel 220.

In diagram 200U of FIG. 2U, operation O240 may include connecting electrical plug 227 with electrical line 226 to electrical outlet 310 (which may also include electrical system 304).

Control Panel of Prefabricated/Modular Sauna

Figure 3:
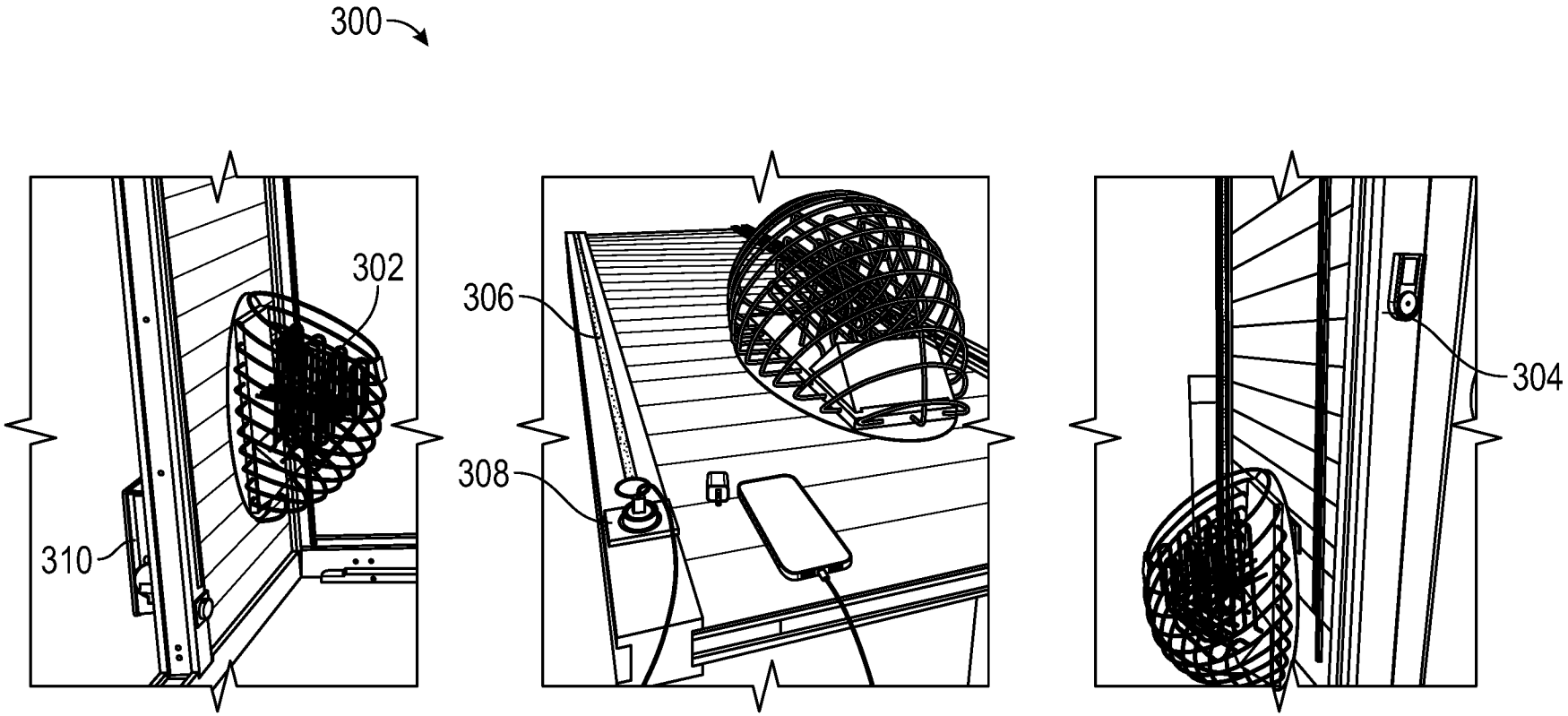
FIG. 3 depicts features of a control panel for the prefabricated/modular sauna with an integrated sauna assembly.

FIG. 3 depicts features of a control panel 219 for the prefabricated/modular sauna with an integrated sauna assembly 300. Features of FIG. 3 may apply to any of the prefabricated/modular saunas of FIGS. 1, 2A-2U, 4, 5A, 5B, 6, 7, 8, and 9. As discussed herein, the control panel 219 may include various pre-assembled components. For instance, the control panel 219 may include posts and a panel pre-packaged with a sauna assembly 300. As discussed herein, the sauna assembly 300 may include: the heating system 302, the electrical system 304, and an electrical outlet 310. In some cases, the sauna assembly 300 may also include the control interface 312. In some cases, the sauna assembly 300 may also include the lighting fixture 306 and the outlet 308 (or other user interface device, such as speaker, display, and the like).

Beams and Posts of Prefabricated/Modular Sauna

Figure 4:
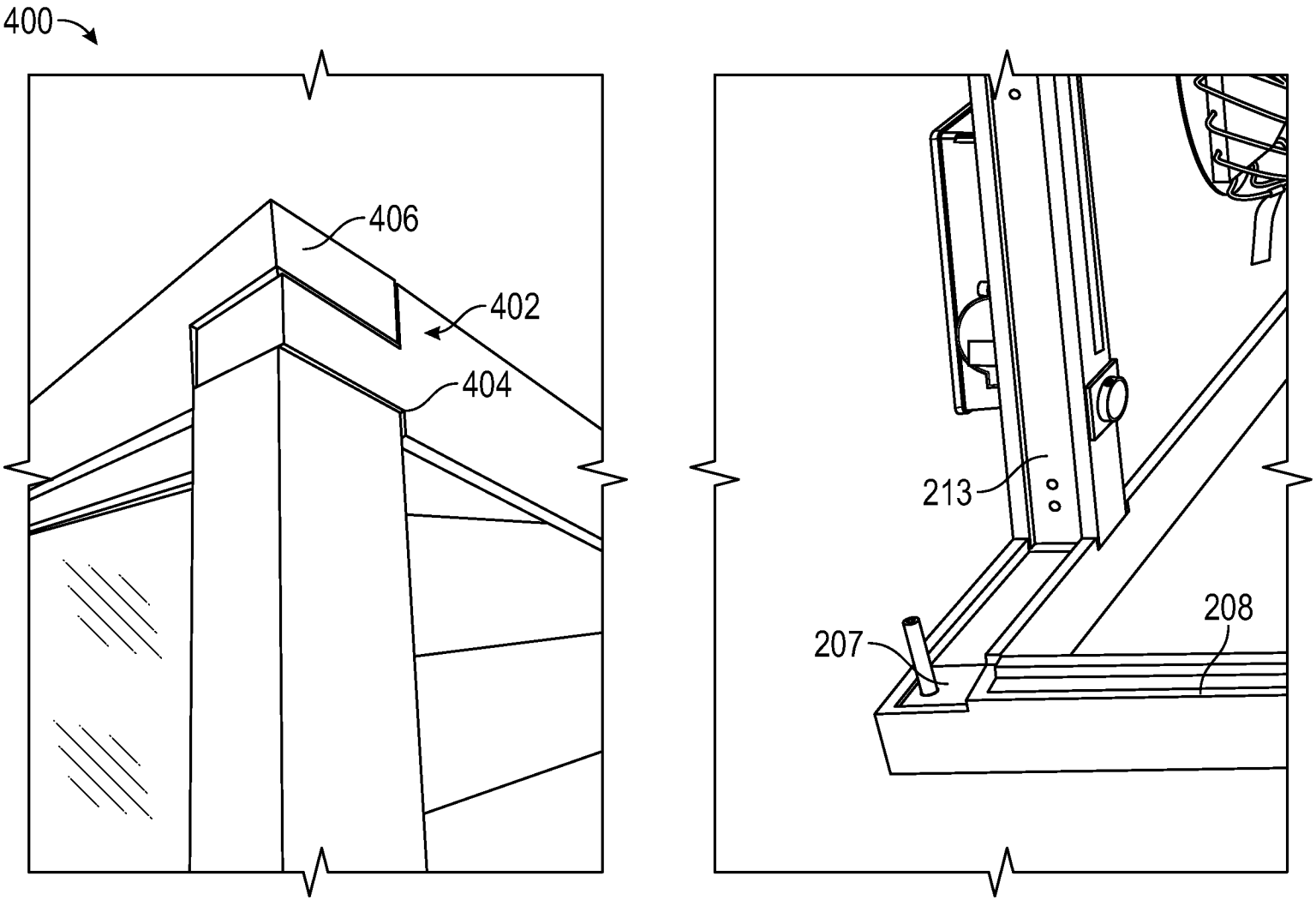
FIG. 4 depicts features of beams and posts of a prefabricated/modular sauna.

FIG. 4 depicts features 400 of beams and posts of a prefabricated/modular sauna. Features of FIG. 4 may apply to any of the prefabricated/modular saunas of FIGS. 1, 2A-2U, 3, 5A, 5B, 6, 7, 8, and 9. The features 400 may depict an example post dado 213, an example base beam dado 208 (same as roof beam dado), and an example notch 207. Additionally, the features 400 may depict how roof beams 224 are secured using roof beam intersections 402 between adjacent roof beams (like the base beams). As discussed herein, each roof beam intersection 402 may be formed of a roof lap joint 406 and a roof pin (not depicted, same as base beam pin). Each roof beam 224 of the plurality of roof beams includes at least one roof beam dado 208 (same as base beam dado) and at least one roof beam notch 404 on a bottom face of the roof beam. Thus, in this manner, each of the plurality of posts are secured in respective roof beam notches and respective base beam notches (e.g., using a roof/base post pin that is inserted into a hole of the roof/base beam notch and a hole on a top/bottom face of the plurality of posts). The plurality of panels may be respectively secured in roof beam dados of the roof beams and base beam dados.

Dimensions of Prefabricated/Modular Sauna

Figure 5A:
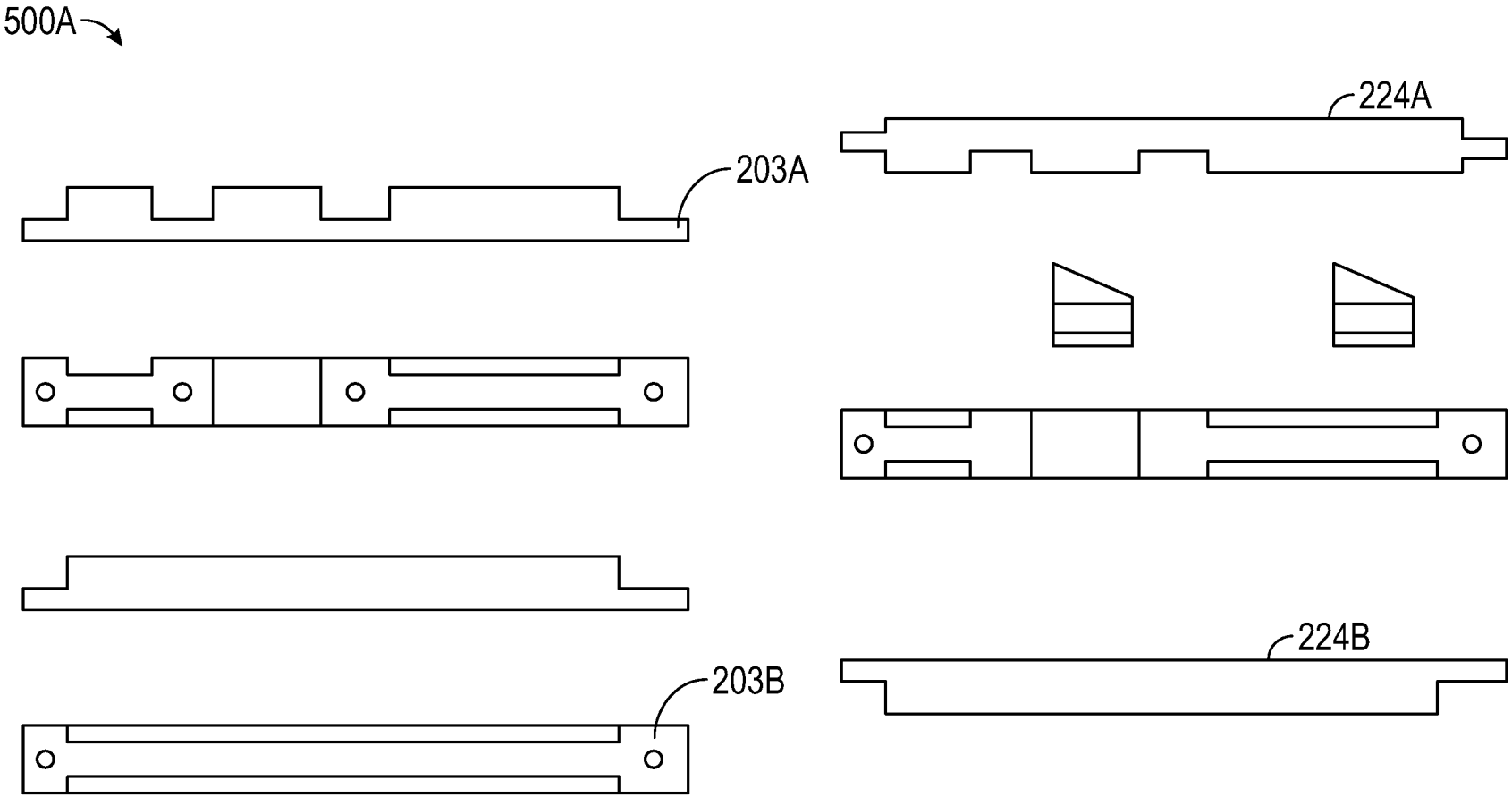
FIGS. 5A and 5B depict exemplary dimensions of a prefabricated/modular sauna.
Figure 5B:
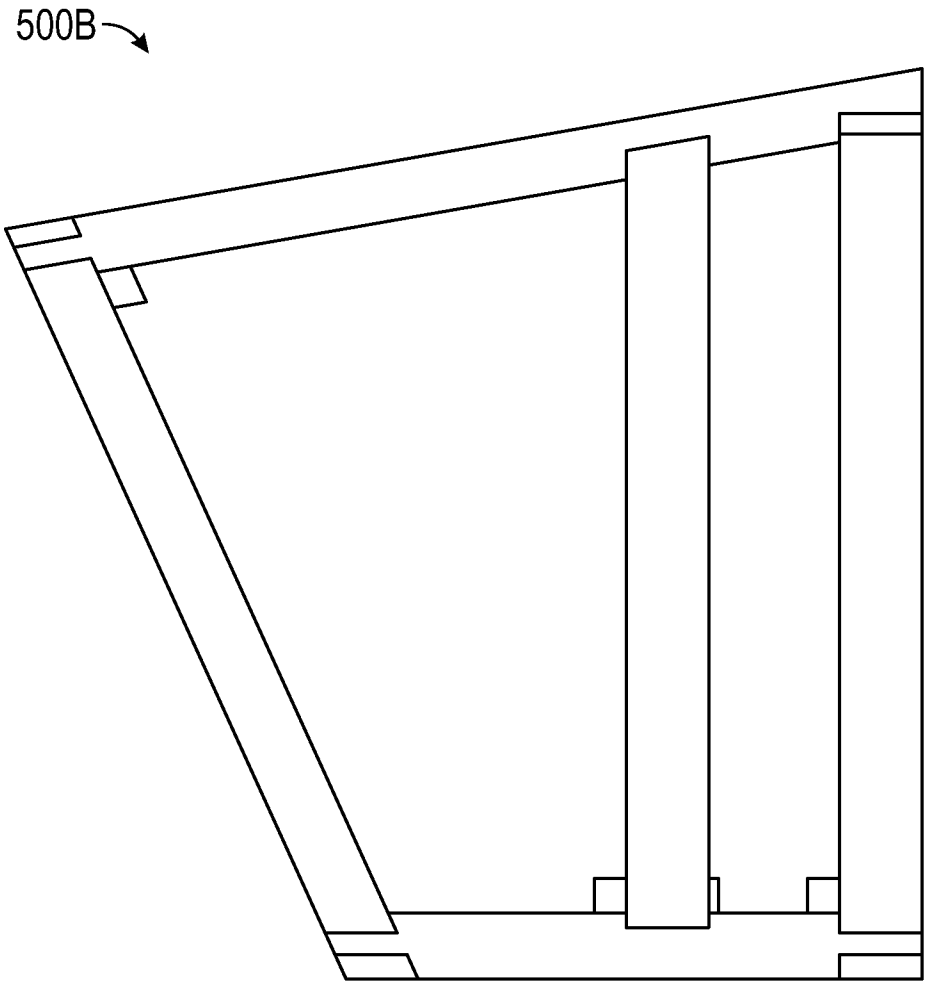

FIGS. 5A and 5B depict exemplary dimensions 500A and 500B of a prefabricated/modular sauna. Features of FIGS. 5A and 5B may apply to any of the prefabricated/modular saunas of FIGS. 1, 2A-2U, 3, 4, 6, 7, 8, and 9. The dimensions 500A may depict example dimensions of top and bottom beams from front and rear of the sauna 11. The dimensions 500B may depict dimensions of posts and side beams of the top and bottom beams.

Method of Manufacturer of Prefabricated/Modular Sauna

Figure 6:
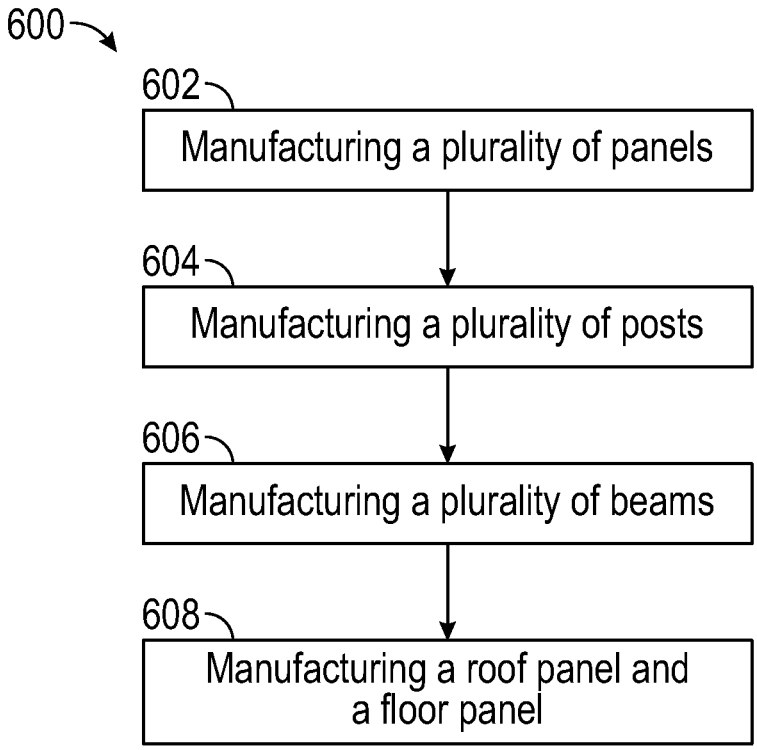
FIG. 6 depicts a method of manufacturing a prefabricated/modular sauna.

FIG. 6 depicts a method 600 of manufacturing a prefabricated/modular sauna. Features of FIG. 6 may apply to any of the prefabricated/modular saunas of FIGS. 1, 2A-2U, 3, 4, 5A, 5B, 7, 8, and 9. The method 600 may start at block 602 by manufacturing a plurality of panels.

For instance, manufacturing the plurality of panels may include selecting appropriate material (e.g., quality of wood, glass, metal and the like), and cutting (and optionally securing together) the material into one or more sets of panels in accordance with dimensions of the one or more sets. For instance, the sets of panels may include one or combinations of: a first set of the plurality of panels that are rectangular, a second set of the plurality of panels that are trapezoidal, and/or a third set of the plurality of panels that are polygonal with four sides that are not parallel to any other side.

At least one panel (e.g., a first panel of the first set of the plurality of panels) may be constructed to include a door. At least one panel (e.g., a second panel of the second set of the plurality of panels) may be constructed to include a sauna assembly. As discussed herein, the sauna assembly may include: a heating system, an electrical system, and an electrical outlet. In the case of a back panel, the back panels may also have tongues and grooves formed on mated ends.

At block 604, the method 600 may include manufacturing a plurality of posts. For instance, manufacturing the plurality of posts may include selecting appropriate material (e.g., quality of wood, glass, metal and the like), and cutting (and optionally securing together) the material into one or more sets of posts in accordance with dimensions of the one or more sets. For instance, each of the posts has at least post dado. In some cases, the posts are of uniform shape and uniform length. In some cases, the posts are different shapes and lengths.

For instance, the sets of posts may include: a first set of the plurality of posts, and a second set of the plurality of posts. At least a first portion of the first set of the plurality of posts may be longer than the second set of the plurality of posts. At least a second portion of first set of the plurality of posts may have a sloped top face. The second set of the plurality of posts have a sloped bottom face. In this manner, the posts may provide support for beams and panels, in a manner that provides various options for visual appearance of the sauna 100 (such as a sloped roof, a sloped back wall, a sloped side wall, a sloped front wall, and the like).

At block 606, the method 600 may include manufacturing a plurality of beams. For instance, manufacturing the plurality of beams may include selecting appropriate material (e.g., quality of wood, glass, metal and the like), and cutting (and optionally securing together) the material into one or more sets of beams in accordance with dimensions of the one or more sets. The sets of beams may include at least base beams and roof beams. The base beams and the roof beams may have notches, lap joints, and beam dados. The locations, sizes, and tolerances of the notches, lap joints, and beam dados may be set in accordance with dimensions of the design and quality metrics of the manufacturing process.

At block 608, the method 600 may include manufacturing a roof panel and a floor panel. For instance, manufacturing the roof panel and the floor panel may include selecting appropriate material (e.g., quality of wood, glass, metal and the like), and cutting (and optionally securing together) the material into the roof panel and the floor panel in accordance with dimensions of the design. In the case of a roof panel, the panels may also have tongues and grooves formed on mated ends.

Event Sauna

Figure 7:
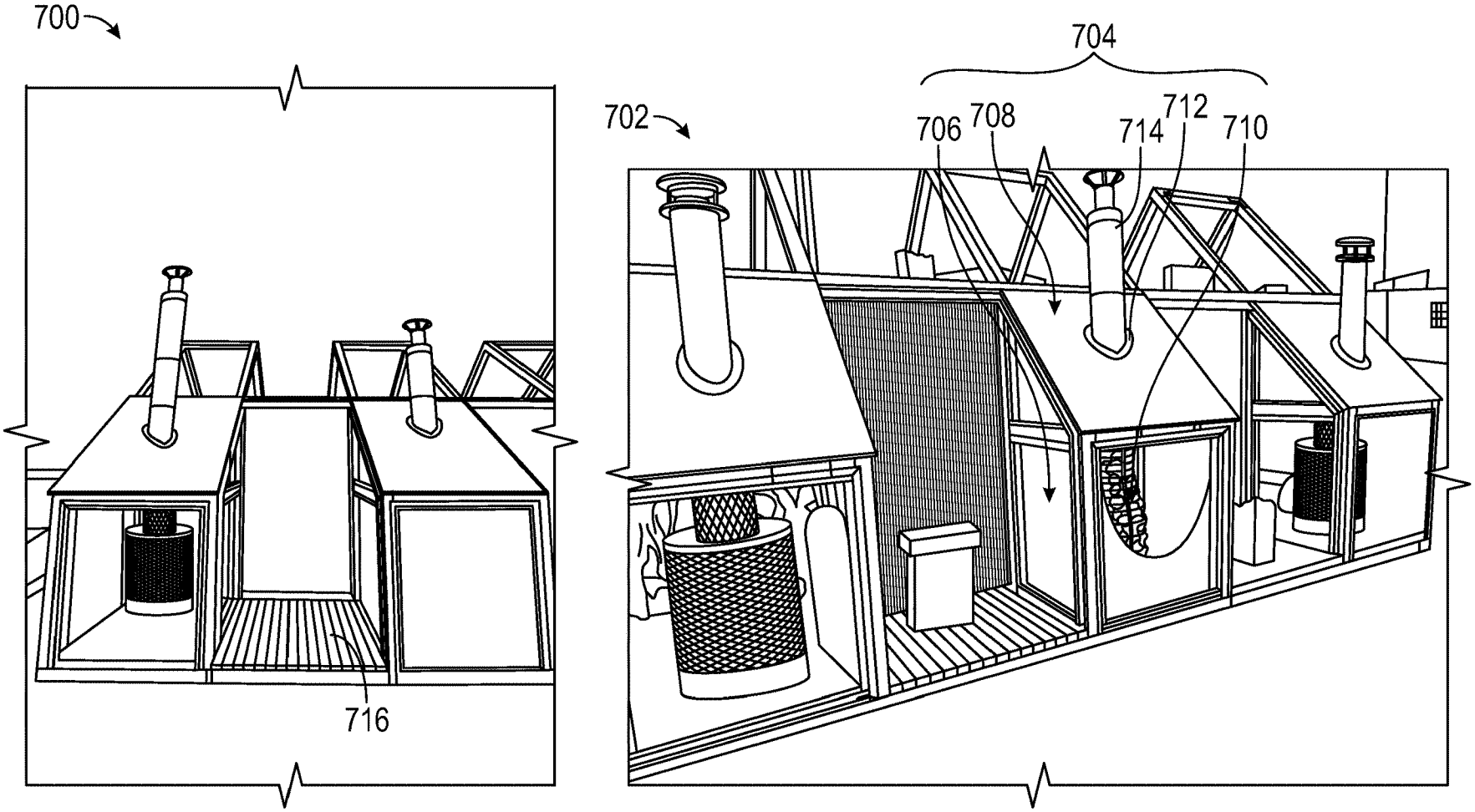
FIG. 7 depicts diagrams of a prefabricated/modular sauna for events.

FIG. 7 depicts diagrams 700 a prefabricated/modular sauna 702 for events. Features of FIG. 7 may apply to any of the prefabricated/modular saunas of FIGS. 1, 2A-2U, 3, 4, 5A, 5B, 6, 8, and 9. The sauna 702 may use posts, beams, and panels as discussed herein. Features of the sauna 702 that are the same as the sauna 100 have been omitted for ease of reference. In particular, sauna 702 may have a modular layout (see FIG. 8) to provide saunas that can scale up or down in size based on end user use-case. To effectuate the scaling up/down, the sauna 700 may also use optional features, such as exterior decking 716 and heating infrastructure 704 (e.g., a larger heater than a wall mounted heating system 302 of sauna 100).

The exterior decking 716 may be supported by base beams (e.g., that run around and below the exterior decking 716, e.g., at regular intervals). The base beams of the exterior decking 716 may be connected to base beams of sauna 702 that support walls and the like. As depicted in FIG. 7, the exterior decking 716 may be disposed between adjacent heating infrastructures 704 of sauna 702, but they may be generally arranged next to, around, or in between walls, door, or heating infrastructure 704 of the sauna 702.

Generally, the sauna 702 may include at least one heating infrastructure 704 or control panel 219. However, the number (e.g., three, as depicted in FIG. 7) may be selected to provide enough heat to sufficiently heat (and distribute the heat within) an internal volume of the sauna 702. The heating infrastructure 704 may include (based on design and use-case) a base portion 706, a roof portion 708, a heating system 710, a roof hole 712, and a vent 714.

The base portion 706 may include panels, base beams, roof beams, and posts supporting the roof beams from the base beams. Like with sauna 100, the base portion 706 may provide structural rigidity using the beams and posts, while panels provide humidity and heat control of the envelope. In some cases, the base portion 706 may include panels above or in between sloped roof beams.

The roof portion 708 may include a panel that provides humidity and heat control of the envelope, and an egress point for the roof hole 712. For instance, when the heating system 710 uses wood or another (non-electric) heating substance, the exhaust may be expelled from the interior volume of the sauna 702 from the heating system 710 through the hole 712 using the vent 714.

In this manner, the heating infrastructure 704 may (based on a number of heating infrastructures 704 selected based on use-case) add additional heat capacity to the sauna 702 by a substitution of a wall panel with the features of the heating infrastructure 704. In this manner, the sauna 702 may be varied based on use-case (e.g., as the sauna 702 is reconfigured to scale up/down in size/internal volume).

Figure 8:
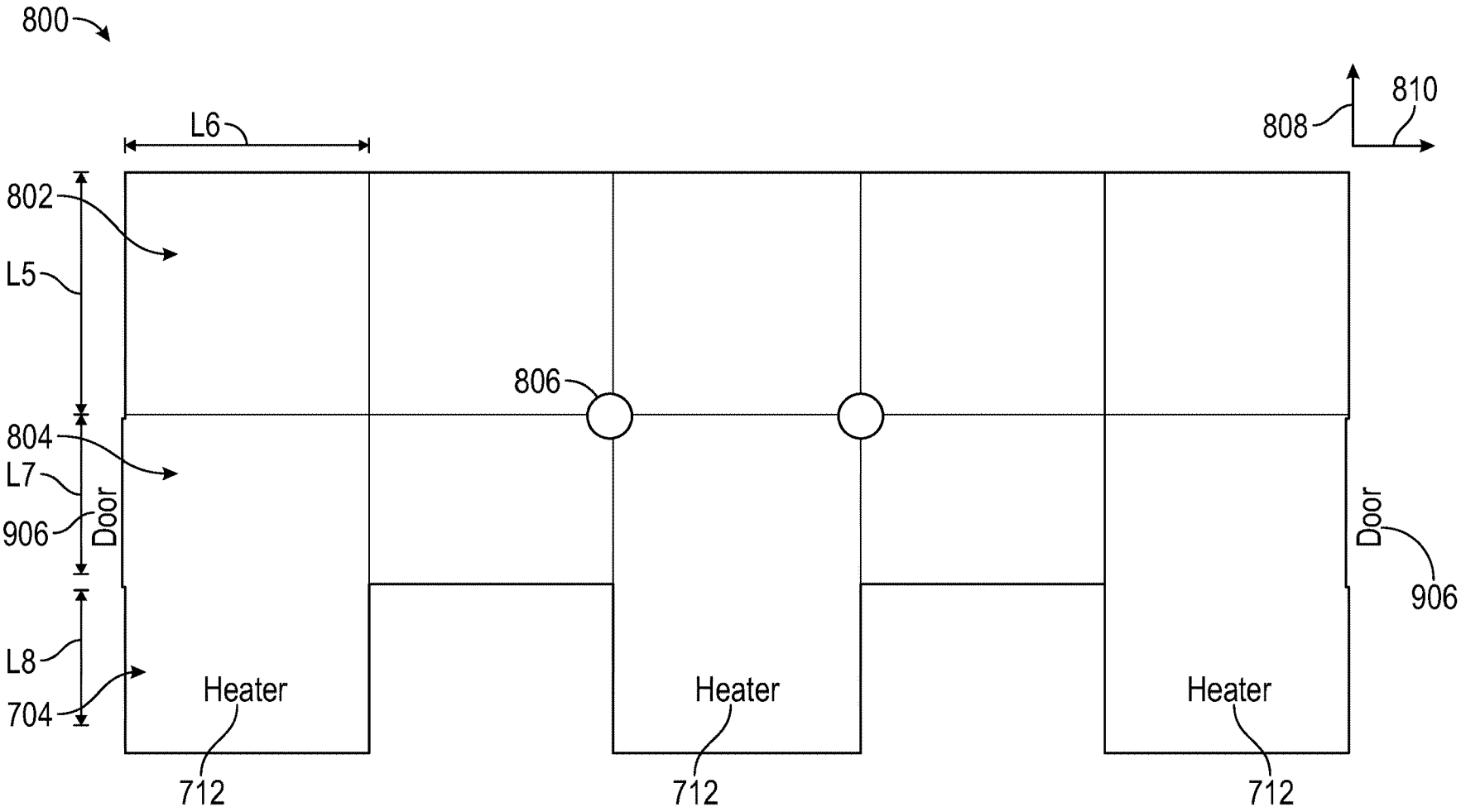
FIG. 8 depicts layout for a prefabricated/modular sauna for events.

FIG. 8 depicts layout 800 for a prefabricated/modular sauna for events. Features of FIG. 8 may apply to any of the prefabricated/modular saunas of FIGS. 1, 2A-2U, 3, 4, 5A, 5B, 6, 7, and 9. As depicted in FIG. 8, the sauna 702 may be a generally rectangular layout, with heating infrastructure 704 arranged along one side (or, not depicted, on multiple sides). In some cases, the layout includes a plurality of modular units of a same size, or different sizes (e.g., first modular unit 802 and second modular unit 804). The modular units may include base beams, panels, and posts to provide a floor, wall, and ceiling of the internal volume of the sauna 702. The first modular unit 802 may have a first length L5 that is different from a first length L7 of the second modular unit 804. The heating infrastructure 704 may have a first length L8 that is the same or different from L5 and L7. While the first and second modular units and the heating infrastructure 704 have a same transverse length L6, they may be different in other configurations. The user may select first or second modular units in a grid pattern in a first direction 808 and a second direction 810. For instance, the grid pattern may be rectangular, square, or other shapes, such as L, T, and the like. A design constraint may be that exterior walls of first/second modular units are continuous (e.g., exterior panels align and the units share a post), so that control of humidity/heat may be maintained. In some cases, interior posts 806 may be provided to support roof panels. Based on use-case, one or more door(s) 906 may replace exterior panels of the sauna 702.

In this manner, the post, beams, and panels of the present disclosure provide a highly modular sauna 702 that can be assembled using none or few mechanical adaptors. For instance, end users may set up seasonal event saunas that can be dis-assembled and assembled as desired. Moreover, the end users may modify (e.g., scale up/down) the size of the modular sauna as desired for a use-case.

Figure 9:
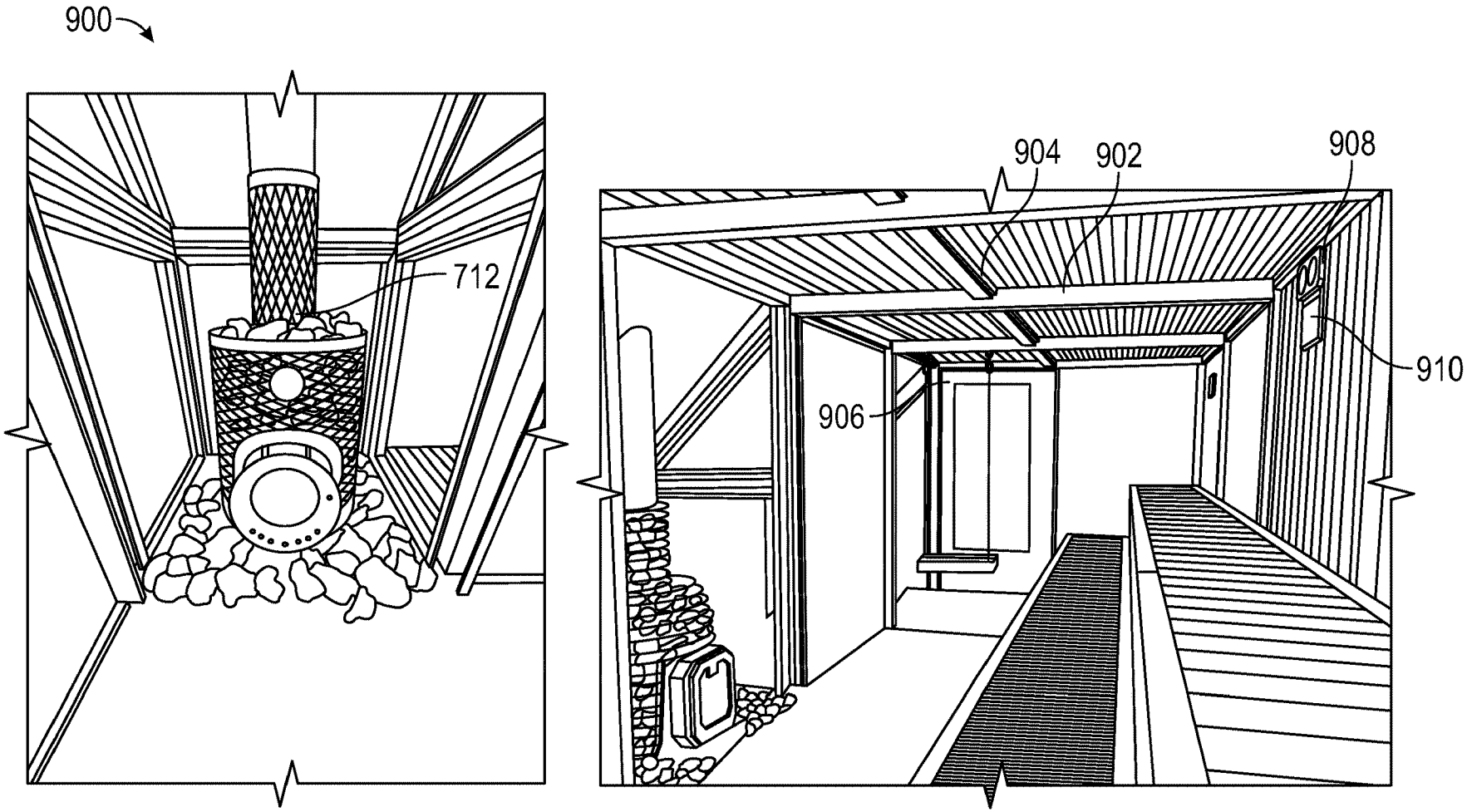
FIG. 9 depicts features of a prefabricated/modular sauna for events.

FIG. 9 depicts features 900 of a prefabricated/modular sauna for events. Features of FIG. 9 may apply to any of the prefabricated/modular saunas of FIGS. 1, 2A-2U, 3, 4, 5A, 5B, 6, 7, 8. The features 900 of the sauna 702 depicts additional features of the sauna 702. In some cases, fans 908 and/or sensors 910 may be provided in exterior walls of a modular unit.

Additionally, in certain configurations, the sauna 702 may include cross beams to support roof panels over larger spans of floor spaces. The cross beams may include at least one first cross beam 902 and at least one second cross beam 904 (each a "set of cross beams"). The first cross beam 902 may run from a first exterior wall post to a second exterior wall post (or interior posts 806) and be a continuous member (e.g., of wood, metal and the like). The first cross beam 902 may provide support to the at least one second cross beam 904. The first cross beam 902 may include a notch to receive/pin the second cross beam. The second cross beam 904 may run from a third exterior wall post to a fourth exterior wall post (or interior posts 806). In some cases, the second cross beam 904 may be a continuous member (e.g., of wood, metal and the like). In some cases, the second cross beam 904 may two beams that abut at and on the notch of the first cross beam 902.

Terminology

The terminology used above may be interpreted in its broadest reasonable manner, even though it is being used in conjunction with a detailed description of certain specific examples of the present disclosure. Indeed, certain terms may even be emphasized above; however, any terminology intended to be interpreted in any restricted manner will be overtly and specifically defined as such in this Detailed Description section. Both the foregoing general description and the detailed description are exemplary and explanatory only and are not restrictive of the features, as claimed.

As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

In this disclosure, relative terms, such as, for example, "about," "substantially," "generally," and "approximately" are used to indicate a possible variation of ±10% in a stated value.

The term "exemplary" is used in the sense of "example" rather than "ideal." As used herein, the singular forms "a," "an," and "the" include plural reference unless the context dictates otherwise.

EXAMPLES

Exemplary embodiments of the prefabricated/modular saunas and methods of manufacturer and assembly disclosed herein are described in the numbered paragraphs below.

A1. A prefabricated/modular sauna comprising:

a base frame forming a base footprint, wherein the base frame includes a plurality of base beams that form a base perimeter of the base footprint and have base beam intersections between adjacent base beams, each base beam intersection is formed of a base beam lap joint and a base beam pin, and each base beam of the plurality of base beams includes at least one base beam dado and at least one base beam notch on a top face of the base beam;

a floor panel configured to be disposed on and secured from lateral movement by the base frame;

a plurality of posts, wherein a first set of the plurality of posts are respectively set in a first set of base beam notches of the base beams and orientated in a first direction, the first direction is about 90 degrees from the base beams in a substantially vertical manner relative to gravity, a second set of the plurality of posts are respectively set in a second set of base beam notches of the base beams and orientated in a second direction, the second direction is about 105 degrees from the base beams in a substantially sloped manner relative to gravity, each of the plurality of posts include at least one post dado, and each of the plurality of posts are secured in respective base beam notches using a base post pin that is inserted into a hole of the base beam notch and a hole on a bottom face of the plurality of posts;

a plurality of panels, wherein a first set of the plurality of panels are rectangular, a second set of the plurality of panels are trapezoidal, a third set of the plurality of panels are polygonal with four sides that are not parallel to any other side, a first panel of the first set of the plurality of panels includes a door, a second panel of the second set of the plurality of panels includes a sauna assembly, the sauna assembly includes:

a heating system disposed on an interior wall of the second panel facing an interior volume of the prefabricated/modular sauna, an electrical system disposed in an internal volume of the second panel and connected to the heating system, and an electrical outlet disposed on an exterior wall of the second panel facing an exterior of the prefabricated/modular sauna and connected to the electrical system, and the plurality of panels are respectively secured in post dados of the posts and base beam dados of the base beams;

a roof frame forming a roof footprint, wherein the roof frame includes a plurality of roof beams that form a roof perimeter of the roof footprint and have roof beam intersections between adjacent roof beams, each roof beam intersection is formed of a roof lap joint and a roof pin, each roof beam of the plurality of roof beams includes at least one roof beam dado and at least one roof beam notch on a bottom face of the roof beam, each of the plurality of posts are secured in respective roof beam notches using a roof post pin that is inserted into a hole of the roof beam notch and a hole on a top face of the plurality of posts, the plurality of panels are respectively secured in roof beam dados of the roof beams; and a roof panel configured to be disposed on and secured from lateral movement by the roof frame.

A2. A prefabricated/modular sauna comprising:

a base frame forming a base footprint;

a floor panel configured to be disposed on the base frame;

a plurality of posts;

a plurality of panels, wherein a first panel of the plurality of panels includes a door, a second panel of the plurality of panels includes a sauna assembly, the sauna assembly includes:

a heating system disposed on an interior wall of the second panel facing an interior volume of the prefabricated/modular sauna, an electrical system disposed on an internal volume of the second panel and connected to the heating system, and an electrical outlet disposed on an exterior wall of the second panel facing an exterior of the prefabricated/modular sauna and connected to the electrical system;

a roof frame forming a roof footprint; and a roof panel configured to be disposed on the roof frame, wherein each of the base frame and the roof frame includes a plurality of beams that form respective perimeters of the respective footprints and have beam intersections between adjacent beams, each beam intersection is formed of a lap joint and a pin, the plurality of panels are respectively secured in post dados of the posts and beam dados of the beams;

each of the plurality of posts are secured in respective base beam notches using a base post pin that is inserted into a hole of the base frame and a hole on a bottom face of the plurality of posts; and each of the plurality of posts are secured in respective roof beam notches using a roof post pin that is inserted into a hole of the roof beam notch and a hole on a top face of the plurality of posts.

A3. The prefabricated/modular sauna of A2, wherein the base footprint is a square or rectangle.

A4. The prefabricated/modular sauna of A3, wherein the floor panel has at least twenty square feet of floorspace on an interior volume of the footprint.

A5. The prefabricated/modular sauna of A3, wherein the roof footprint is a square or rectangle.

A6. The prefabricated/modular sauna of A3, wherein the roof footprint is greater than the base footprint.

A7. The prefabricated/modular sauna of any of A2-A6, wherein the plurality of panels include at least some panels formed of wood and at least some panels formed of glass.

A8. The prefabricated/modular sauna of any of A2-A7, wherein the second panel is prepackaged with the sauna assembly.

A9. The prefabricated/modular sauna of any of A2-A8, wherein the sauna assembly includes a control interface.

A10. The prefabricated/modular sauna of A9, wherein the control interface is a part of the heating system, or separate from the heating system and separately connected to the electrical system.

A11. The prefabricated/modular sauna of A9, wherein the sauna assembly includes a lighting fixture.

A12. The prefabricated/modular sauna of A11, wherein the lighting fixture is disposed in an interior facing dado of the second panel or post associated with the second panel.

A13. The prefabricated/modular sauna of A9, wherein the second panel is prepackaged with posts associated with the second panel.

A14. The prefabricated/modular sauna of A13, wherein the sauna assembly includes one or combinations of: an outlet, a speaker, or an entertainment system, disposed on the interior wall.

A15. The prefabricated/modular sauna of any of A2-A6, wherein the door extends from floorspace to roof.

A16. The prefabricated/modular sauna of A15, wherein the door is reversable configured to open outward in a first rotation or a second rotation.

A17. The prefabricated/modular sauna of any of A2-A16, wherein the roof panel is secured by rails along lateral sides of the prefabricated/modular sauna, wherein the rails are formed in the roof beams on the lateral sides of the prefabricated/modular sauna.

A18. The prefabricated/modular sauna of A17, wherein the roof panel includes a ceiling panel formed in two parts secured together by a tongue and groove connection.

A19. The prefabricated/modular sauna of A17, wherein the roof panel includes an exterior panel formed in two parts and connected by a weather resistant material.

A20. The prefabricated/modular sauna of any of A2-A19, wherein a third panel of the first set of the plurality of panels is a backwall panel, the backwall panel is formed in two parts secured together by a tongue and groove connection.

A21. The prefabricated/modular sauna of any of A2-A20, wherein corner posts of the plurality of posts include a first post dado on a first face of the post and a second post dado on a second face of the post, and the first face is adjacent the second face.

A22. The prefabricated/modular sauna of A21, wherein the first face is rotated 90 degrees relative to the second face.

A23. The prefabricated/modular sauna of A22, wherein back corner posts have a bottom face that is sloped to about 105 degrees from an axial direction of the post, so as to cause the second direction to point away from a front of the prefabricated/modular sauna.

A24. The prefabricated/modular sauna of any of A2-A23, wherein intermediate posts of the plurality of posts include a first post dado on a first face of the post and a second post dado on a second face of the post, and the first face is opposite the second face.

A25. The prefabricated/modular sauna of A24, wherein the intermediate posts have a top face that is sloped to about 105 degrees from an axial direction of the post, so as to slope upward from a back to a front of the prefabricated/modular sauna.

A26. The prefabricated/modular sauna of any of A2-A25, wherein at least some of the base beam pins are used as the base post pins.

A27. The prefabricated/modular sauna of any of A2-A26, wherein at least some of the roof beam pins are used as the roof post pins.

A28. A method of assembly of a prefabricated/modular sauna comprising: assembling the prefabricated/modular sauna of A1 in accordance with instructions and without mechanical connectors.

A29. A method of manufacturing a prefabricated/modular sauna comprising: manufacturing a plurality of panels including at least:

a first set of the plurality of panels that are rectangular,
a second set of the plurality of panels that are trapezoidal,
a third set of the plurality of panels that are polygonal with four sides that are not parallel to any other side, wherein
a first panel of the first set of the plurality of panels including a door,
a second panel of the second set of the plurality of panels includes a sauna assembly, the sauna assembly includes:
a heating system disposed on an interior wall of the second panel facing an interior volume of the prefabricated/modular sauna,
an electrical system disposed on an internal volume of the second panel and connected to the heating system, and
an electrical outlet disposed on an exterior wall of the second panel facing an exterior of the prefabricated/modular sauna and connected to the electrical system;

manufacturing a plurality of posts including at least:
a first set of the plurality of posts, and
a second set of the plurality of posts, wherein
at least a first portion of the first set of the plurality of posts are longer than the second set of the plurality of posts,
at least a second portion of first set of the plurality of posts have a sloped top face,
the second set of the plurality of posts have a sloped bottom face, and
each of the posts has at least post dado;

manufacturing a plurality of beams including at least base beams and roof beams, wherein the base beams and the roof beams have notches, lap joints, and beam dados; and manufacturing a roof panel and a floor panel.

A30. A modular sauna comprising:

a plurality of modular units, wherein each modular unit includes:
a base frame forming a base footprint;
a floor panel configured to be disposed on the base frame;
a plurality of posts;
a plurality of panels,
a roof frame forming a roof footprint; and
a roof panel configured to be disposed on the roof frame; and at least one heating infrastructure to heat an interior volume of the modular sauna, wherein
each of the base frame and the roof frame includes a plurality of beams that form respective perimeters of the respective footprints and have beam intersections between adjacent beams,
each beam intersection is formed of a lap joint and a pin,
the plurality of panels are respectively secured in post dados of the posts and beam dados of the beams;
each of the plurality of posts are secured in respective base beam notches using a base post pin that is inserted into a hole of the base frame and a hole on a bottom face of the plurality of posts; and each of the plurality of posts are secured in respective roof beam notches using a roof post pin that is inserted into a hole of the roof beam notch and a hole on a top face of the plurality of posts.

A31. The modular sauna of A30, wherein the at least one heating infrastructure includes a base portion, a roof portion, a heating system, a roof hole, and a vent.

A32. The modular sauna of claim 14, wherein the at least one heating infrastructure is arranged on an exterior wall of a modular unit.

A33. The modular sauna of any of A30-A32, wherein the plurality of modular units are arranged in a grid pattern.

A34. The modular sauna of any of A30-A33, wherein the plurality of modular units include a first modular unit and a second modular unit having different dimensions in width or length.

A35. The modular sauna of any of A30-A34, wherein the plurality of modular units are arranged such that exterior walls of plurality of modular units are continuous.

A36. The modular sauna of any of A30-A35, wherein at least some of the plurality of modular units include cross beams to support roof panels across a span of at least two modular units without interior posts or exterior wall posts supporting the span.

Other aspects of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A prefabricated/modular sauna comprising:

a base frame forming a base footprint, wherein the base frame includes a plurality of base beams that form a base perimeter of the base footprint and have base beam intersections between adjacent base beams, each base beam intersection is formed of a base beam lap joint and a base beam pin, a first base beam lap joint includes a first end of a first beam and a second end of a second beam that interlace or overlap and are secured by a corresponding base beam pin, and each base beam of the plurality of base beams includes at least one base beam dado and at least one base beam notch, wherein each base beam notch of the at least one base beam notch are on lateral surfaces of the base beams and extend transversally across the base beam, and each base beam dado of the at least one base beam dado are on a surface perpendicular to the lateral surfaces and are perpendicular to the base beam notches extending transversally;

a floor panel configured to be disposed on and secured from lateral movement by the base frame;

a plurality of posts, wherein a first set of the plurality of posts are respectively set in a first set of base beam notches of the base beams and orientated in a first direction, the first direction is about 90 degrees from the base beams in a substantially vertical manner relative to gravity, a second set of the plurality of posts are respectively set in a second set of base beam notches of the base beams and orientated in a second direction, the second direction is about 105 degrees from the base beams in a substantially sloped manner relative to gravity, each of the plurality of posts include at least one post dado, and each of the plurality of posts are secured in respective base beam notches using a base post pin that is inserted into a hole of the base beam notch and a hole on a bottom face of the plurality of posts, wherein the holes of the base beam notches are located where the base beam notches extending transversally overlap with the base beam dados;

a plurality of panels, wherein a first set of the plurality of panels are rectangular, a second set of the plurality of panels are trapezoidal, a third set of the plurality of panels are polygonal with four sides that are not parallel to any other side, a first panel of the first set of the plurality of panels includes a door, a second panel of the second set of the plurality of panels includes a sauna assembly, the sauna assembly includes:

a heating system disposed on an interior wall of the second panel facing an interior volume of the prefabricated/modular sauna, an electrical system disposed in an internal volume of the second panel and connected to the heating system, and an electrical outlet disposed on an exterior wall of the second panel facing an exterior of the prefabricated/modular sauna and connected to the electrical system, and the plurality of panels are respectively secured in post dados of the posts and base beam dados of the base beams;

a roof frame forming a roof footprint, wherein the roof frame includes a plurality of roof beams that form a roof perimeter of the roof footprint and have roof beam intersections between adjacent roof beams, each roof beam intersection is formed of a roof lap joint and a roof pin, each roof beam of the plurality of roof beams includes at least one roof beam dado and at least one roof beam notch on a bottom face of the roof beam, each of the plurality of posts are secured in respective roof beam notches using a roof post pin that is inserted into a hole of the roof beam notch and a hole on a top face of the plurality of posts, the plurality of panels are respectively secured in roof beam dados of the roof beams; and a roof panel configured to be disposed on and secured from lateral movement by the roof frame.

2. A prefabricated/modular sauna comprising:

a base frame forming a base footprint;

a floor panel configured to be disposed on the base frame;

a plurality of posts;

a plurality of panels, wherein a first panel of the plurality of panels includes a door, a second panel of the plurality of panels includes a sauna assembly, the sauna assembly includes:

a heating system disposed on an interior wall of the second panel facing an interior volume of the prefabricated/modular sauna, an electrical system disposed on an internal volume of the second panel and connected to the heating system, and an electrical outlet disposed on an exterior wall of the second panel facing an exterior of the prefabricated/modular sauna and connected to the electrical system;

a roof frame forming a roof footprint; and a roof panel configured to be disposed on the roof frame, wherein each of the base frame and the roof frame includes a plurality of beams that form respective perimeters of the respective footprints and have beam intersections between adjacent beams, each beam intersection is formed of a lap joint and a pin, a first lap joint includes a first end of a first beam and a second end of a second beam that interlace or overlap and are secured by a corresponding pin, the plurality of panels are respectively secured in post dados of the posts and base beam dados of the beams;

each of the plurality of posts are secured in respective base beam notches using a base post pin that is inserted into a hole of the base bame notch and a hole on a bottom face of the plurality of posts; and each of the plurality of posts are secured in respective roof beam notches using a roof post pin that is inserted into a hole of the roof beam notch and a hole on a top face of the plurality of posts, wherein each base beam notch of the base beam notches are on lateral surfaces of the base frame beams and extend transversally across the base frame beam, and each base beam dado of the base beam dados are on a surface perpendicular to the lateral surfaces and are perpendicular to the base beam notches extending transversally, and wherein the holes of the base beam notches are located where the base beam notches extending transversally overlap with the base beam dados.

3. The prefabricated/modular sauna of claim 2, wherein the plurality of panels include at least some panels formed of wood and at least some panels formed of glass.

4. The prefabricated/modular sauna of claim 2, wherein the second panel is prepackaged with the sauna assembly.

5. The prefabricated/modular sauna of claim 2, wherein the sauna assembly includes a control interface.

6. The prefabricated/modular sauna of claim 5, wherein the control interface is a part of the heating system, or separate from the heating system and separately connected to the electrical system.

7. The prefabricated/modular sauna of claim 2, wherein the sauna assembly includes a lighting fixture.

8. The prefabricated/modular sauna of claim 7, wherein the lighting fixture is disposed in an interior facing dado of the second panel or post associated with the second panel.

9. The prefabricated/modular sauna of claim 2, wherein the second panel is prepackaged with posts associated with the second panel.

10. The prefabricated/modular sauna of claim 2, wherein the roof panel is secured by rails along lateral sides of the prefabricated/modular sauna, wherein the rails are formed in the roof beams on the lateral sides of the prefabricated/modular sauna, wherein the roof panel includes a ceiling panel formed in two parts secured together by a tongue and groove connection.

11. The prefabricated/modular sauna of claim 2, wherein a third panel of the plurality of panels is a backwall panel, and the backwall panel is formed in two parts secured together by a tongue and groove connection.

12. The prefabricated/modular sauna of claim 2, wherein corner posts of the plurality of posts include a first post dado on a first face of the post and a second post dado on a second face of the post, and the first face is adjacent the second face.

13. The prefabricated/modular sauna of claim 2, wherein intermediate posts of the plurality of posts include a first post dado on a first face of the post and a second post dado on a second face of the post, and the first face is opposite the second face.

14. A modular sauna comprising:

a plurality of modular units, wherein each modular unit includes:

a base frame forming a base footprint;

a floor panel configured to be disposed on the base frame;

a plurality of posts;

a plurality of panels, a roof frame forming a roof footprint; and a roof panel configured to be disposed on the roof frame; and at least one heating infrastructure to heat an interior volume of the modular sauna, wherein each of the base frame and the roof frame includes a plurality of beams that form respective perimeters of the respective footprints and have beam intersections between adjacent beams, each beam intersection is formed of a lap joint and a pin, the plurality of panels are respectively secured in post dados of the posts and base beam dados of the beams;

each of the plurality of posts are secured in respective base beam notches using a base post pin that is inserted into a hole of the base beam notch and a hole on a bottom face of the plurality of posts; and each of the plurality of posts are secured in respective roof beam notches using a roof post pin that is inserted into a hole of the roof beam notch and a hole on a top face of the plurality of posts, wherein each base beam notch of the base beam notches are on lateral surfaces of the base frame beams and extend transversally across the base frame beam, and each base beam dado of the base beam dados are on a surface perpendicular to the lateral surfaces and are perpendicular to the base beam notches extending transversally, and wherein the holes of the base beam notches are located where the base beam notches extending transversally overlap with the base beam dados.

15. The modular sauna of claim 14, wherein the at least one heating infrastructure includes a base portion, a roof portion, a heating system, a roof hole, and a vent.

16. The modular sauna of claim 14, wherein the at least one heating infrastructure is arranged on an exterior wall of a modular unit.

17. The modular sauna of claim 14, wherein the plurality of modular units are arranged in a grid pattern.

18. The modular sauna of claim 14, wherein the plurality of modular units include a first modular unit and a second modular unit having different dimensions in width or length.

19. The modular sauna of claim 14, wherein the plurality of modular units are arranged such that exterior walls of the plurality of modular units are continuous.

20. The modular sauna of claim 14, wherein at least some of the plurality of modular units include cross beams to support roof panels across a span of at least two modular units without interior posts or exterior wall posts supporting the span.

* * * * *